US008547228B2

(12) United States Patent
Brodzik et al.

(10) Patent No.: US 8,547,228 B2
(45) **Date of Patent: *Oct. 1, 2013**

(54) MULTI-ATTACH REUSABLE TAG

(75) Inventors: James Brodzik, Somerdale, NJ (US); Anthony F. Piccoli, West Deptford, NJ (US); Lawrence Appalucci, Villanova, PA (US); Gary Mazoki, Sewell, NJ (US); Thomas J. McKeown, Pennsauken, NJ (US); Seth Strauser, Sewell, NJ (US); Wei Wu, Shanghai (CN)

(73) Assignee: Checkpoint Systems, Inc., Thorofare, NJ (US)

( * ) Notice: Subject to any disclaimer, the term of this patent is extended or adjusted under 35 U.S.C. 154(b) by 127 days.

This patent is subject to a terminal disclaimer.

(21) Appl. No.: 13/192,077

(22) Filed: Jul. 27, 2011

(65) Prior Publication Data

US 2012/0032805 A1 Feb. 9, 2012

Related U.S. Application Data

(63) Continuation-in-part of application No. 12/887,229, filed on Sep. 21, 2010, which is a continuation-in-part of application No. 12/482,934, filed on Jun. 11, 2009, now Pat. No. 8,344,891.

(60) Provisional application No. 61/163,677, filed on Mar. 26, 2009, provisional application No. 61/157,237, filed on Mar. 4, 2009.

(51) Int. Cl.

| | |
|---|---|
| ***G08B 13/14*** | (2006.01) |
| ***E05B 63/00*** | (2006.01) |
| ***E05B 65/00*** | (2006.01) |
| ***E05B 69/00*** | (2006.01) |

(52) U.S. Cl.

USPC ..... 340/568.1; 340/568.4; 340/568.5; 340/571; 340/572.1; 70/4; 70/6; 70/57.1; 70/58

(58) Field of Classification Search

None

See application file for complete search history.

(56) References Cited

U.S. PATENT DOCUMENTS 4,502,305 A * 3/1985 Bakker ..... 70/49

(Continued)

FOREIGN PATENT DOCUMENTS

CN 201122327 Y 9/2008

(Continued)

OTHER PUBLICATIONS

International Search Report for related PCT Application No. PCT/US2011/051593 dated Feb. 17, 2012.

(Continued)

*Primary Examiner* — Julie Lieu

(74) *Attorney, Agent, or Firm* — Caesar, Rivise, Bernstein, Cohen & Pokotilow, Ltd.

(57) ABSTRACT

A multi-attach reusable security tag (MARST) that is attached to an article in two stages. In a first stage, an attachment clip is coupled to an article, such as but not limited to clothing, to be protected by a manufacturer or assembler. This attachment clip is durable to withstand harsh manufacturing environments. Once the article with the attachment clip is ready for presentation, for example, at a retail establishment, during a second stage, the attachment clip is then secured in a releasable locking mechanism of a housing containing a security element therein. The security element may comprise EAS (including AM, RF, EM and microwave), RFID (including LF, HF and UHF) elements or any combination thereof. Alternatively, a fluke element can be used to secure the attachment clip to the releasable locking mechanism and wherein this fluke element permits the attachment clip to swivel outside of the housing. A preferred embodiment of the security tag uses all non-ferrous components including its locking mechanism. Thus, the security tags combine the qualities of being non-ferrous, light-weight, low cost, deactivatable, secure, visually-deterring, and installable in two stages to the article it is meant to protect.

20 Claims, 16 Drawing Sheets

(56) References Cited

U.S. PATENT DOCUMENTS

| | | | | |
|---|---|---|---|---|
| 4,546,345 | A | 10/1985 | Naito | |
| 5,070,581 | A | 12/1991 | Senter | |
| 5,508,684 | A * | 4/1996 | Becker | 340/572.5 |
| 5,515,580 | A | 5/1996 | McHenry, Jr. | |
| 5,524,463 | A * | 6/1996 | Schenkel et al. | 70/57.1 |
| 5,535,606 | A * | 7/1996 | Nguyen et al. | 70/57.1 |
| 5,583,489 | A | 12/1996 | Loemker et al. | |
| 5,615,454 | A | 4/1997 | Contarino | |
| 5,627,520 | A * | 5/1997 | Grubbs et al. | 340/572.1 |
| 5,689,237 | A | 11/1997 | Sasagawa et al. | |
| 5,699,591 | A | 12/1997 | Kane | |
| 5,945,909 | A * | 8/1999 | Kolton | 340/572.1 |
| 5,969,613 | A * | 10/1999 | Yeager et al. | 340/572.9 |
| 6,052,876 | A | 4/2000 | Hogan et al. | |
| 6,188,320 | B1 * | 2/2001 | Kolton et al. | 340/572.9 |
| 6,254,953 | B1 | 7/2001 | Elston | |
| 6,380,855 | B1 | 4/2002 | Ott | |
| 6,624,753 | B2 | 9/2003 | Elston | |
| 6,646,554 | B1 | 11/2003 | Goff et al. | |
| 6,780,265 | B2 | 8/2004 | Bleckmann et al. | |
| 7,129,841 | B2 | 10/2006 | Feibelman | |
| 7,183,914 | B2 | 2/2007 | Norman et al. | |
| 7,183,917 | B2 | 2/2007 | Piccoli et al. | |
| 7,227,467 | B2 | 6/2007 | Feibelman | |
| 7,456,741 | B2 | 11/2008 | Norman et al. | |
| 7,474,209 | B2 | 1/2009 | Marsilio et al. | |
| 7,518,521 | B2 * | 4/2009 | Feibelman et al. | 340/572.9 |
| 7,808,390 | B2 | 10/2010 | Sayegh | |
| 2005/0128089 | A1 * | 6/2005 | Feibelman | 340/572.9 |
| 2006/0026809 | A1 * | 2/2006 | Copen et al. | 24/704.1 |
| 2006/0238343 | A1 * | 10/2006 | Leyden et al. | 340/572.1 |
| 2007/0067971 | A1 * | 3/2007 | Nguyen et al. | 24/704.1 |
| 2009/0135014 | A1 | 5/2009 | Bleckmann et al. | |
| 2010/0225485 | A1 | 9/2010 | Appalucci et al. | |
| 2011/0199210 | A1 | 8/2011 | McLean | |

FOREIGN PATENT DOCUMENTS

| | | |
|---|---|---|
| EP | 1548640 | 6/2005 |
| EP | 1171300 | 11/2005 |
| GB | 2187706 | 9/1987 |
| GB | 2305212 | 4/1997 |
| JP | 2002074530 | 3/2002 |
| KR | 20030079036 | 10/2003 |
| WO | 98/40591 | 9/1998 |
| WO | 2006127674 | 11/2006 |
| WO | 2008/068725 | 6/2008 |

OTHER PUBLICATIONS

International Search Report for related PCT Application No. PCT/US2009/047245 dated Oct. 20, 2009.

* cited by examiner

4/16
722A
741
739
722B
724A
724
723
726A
728A
730
741
739
726A
722A
726A
7
722B
731B
731A
5
5
728
728A
729
727
750
725
740
724B
728B
723
7
743
742
724A
724
726B
722B
729
727
728A
723
724A
748

1024A
14
1024A
920
1024A
922
922A
14
939
922B
12
12
10
10
10

FIG.15
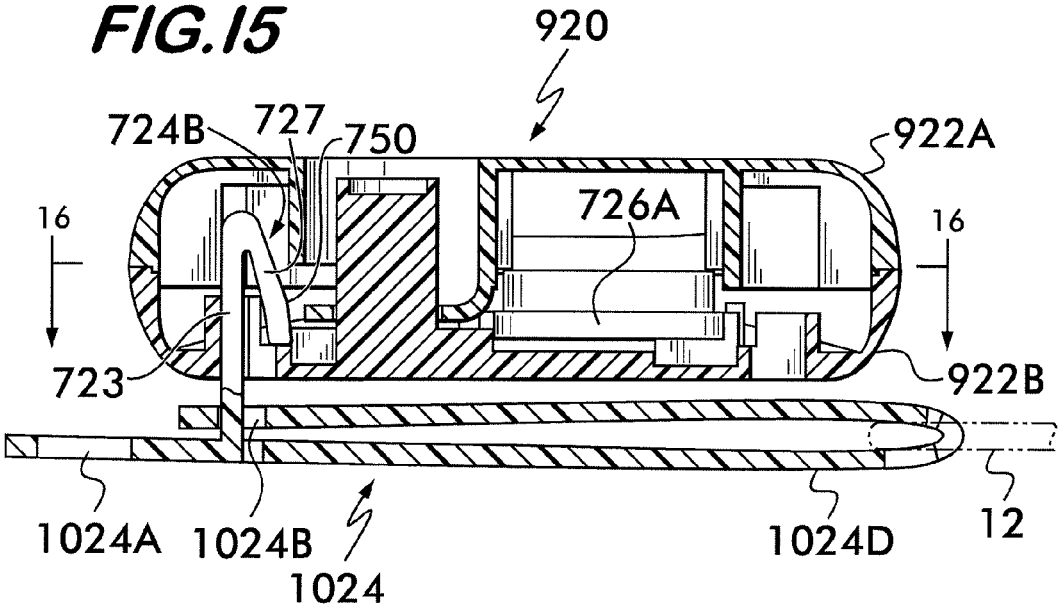
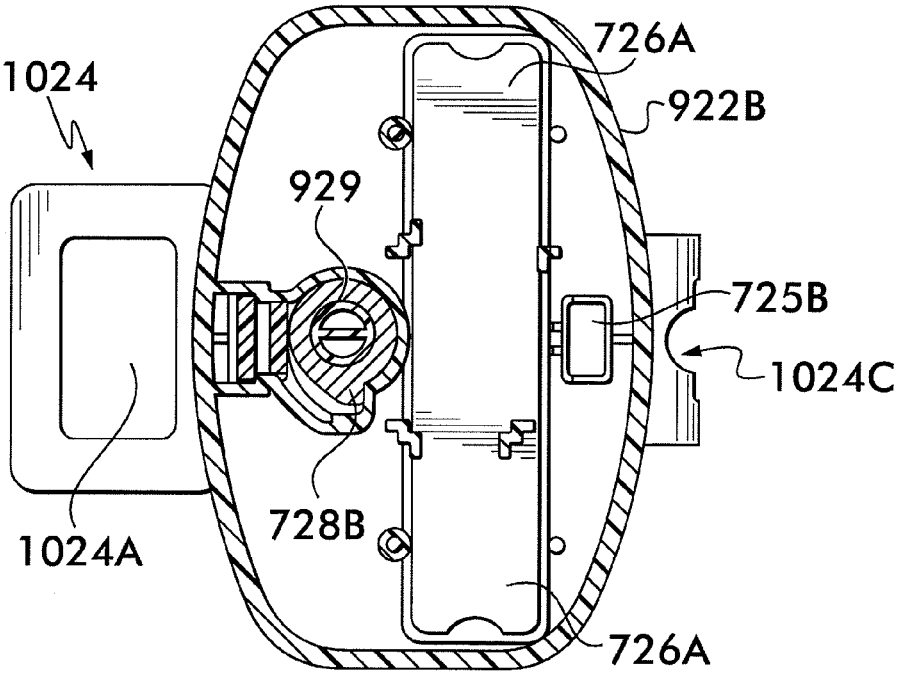
FIG.16

FIG.17
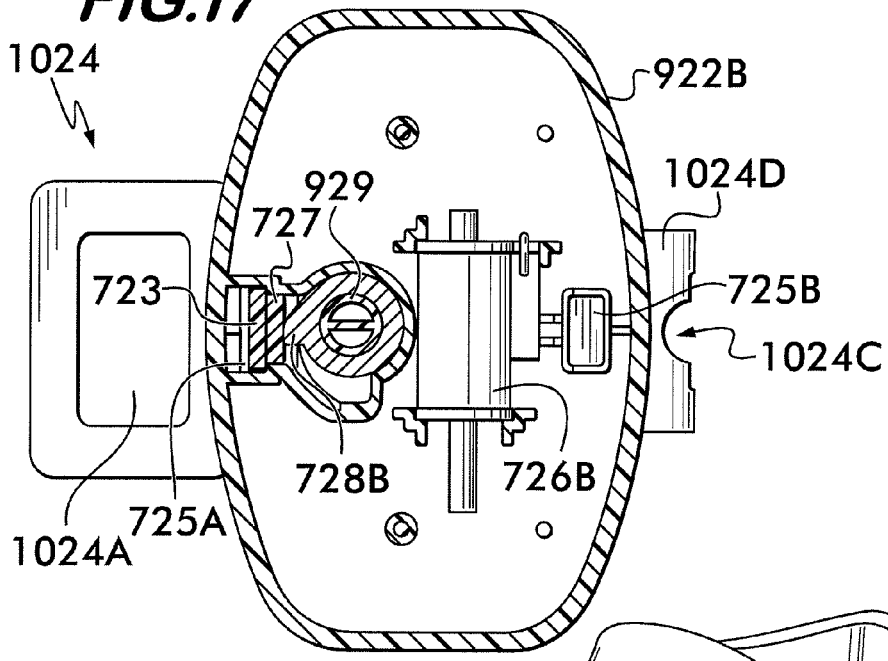
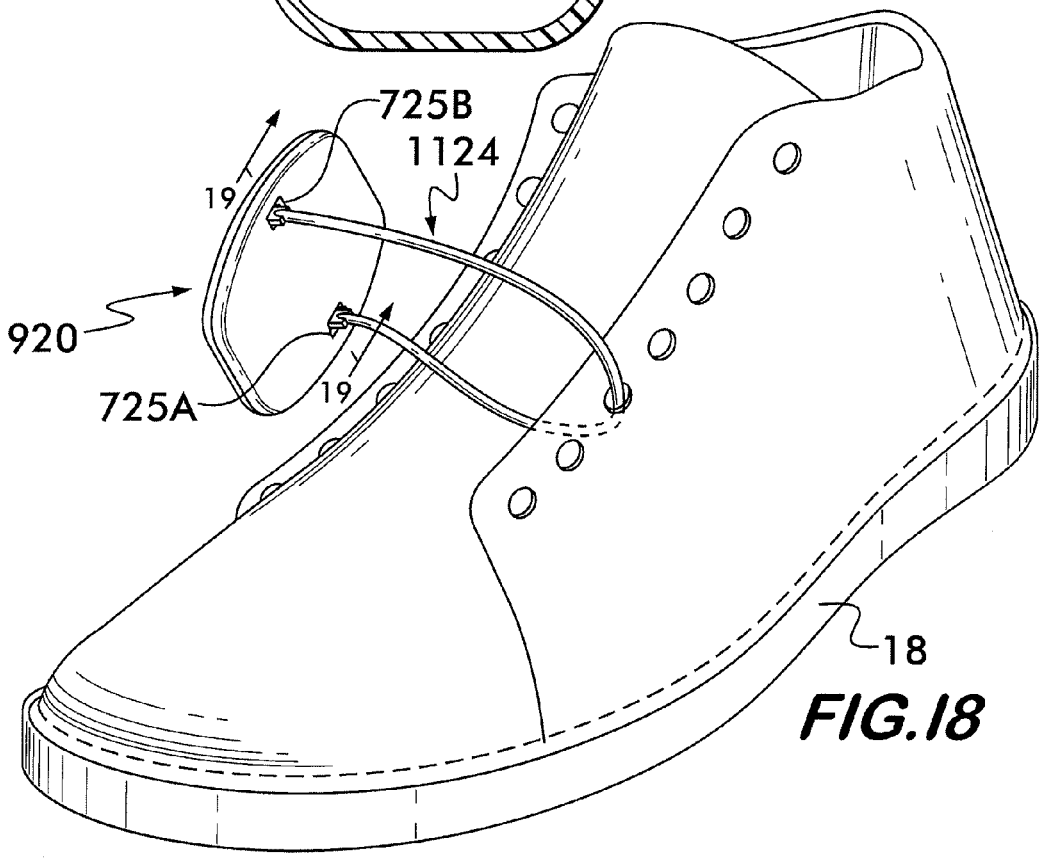
FIG.18

FIG.30
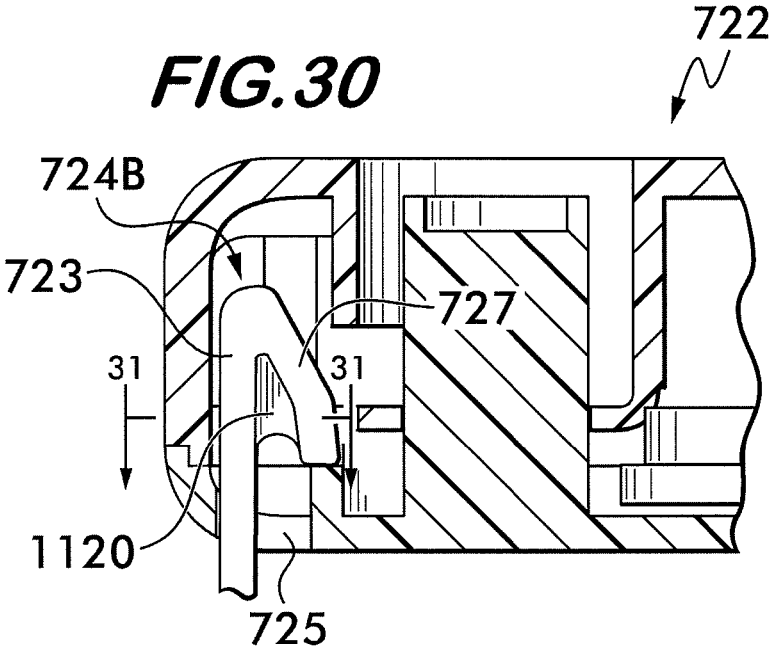
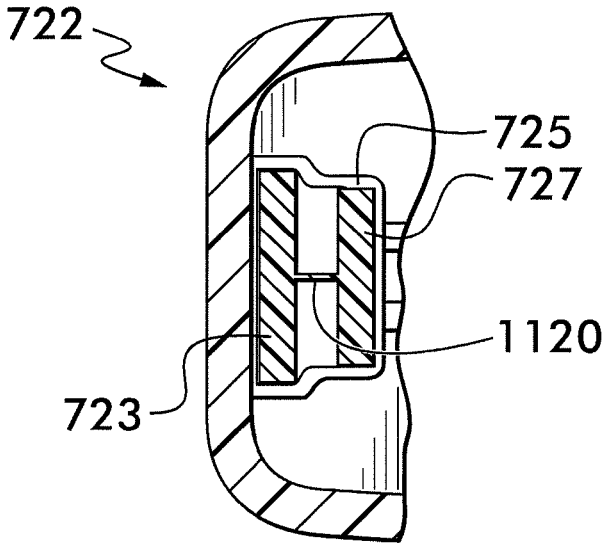
FIG.31

MULTI-ATTACH REUSABLE TAG

CROSS-REFERENCE TO RELATED APPLICATIONS

This continuation-in-part application claims the benefit under 35 U.S.C. §120 of application Ser. No. 12/887,229 filed on Sep. 21, 2010 entitled TWO-STAGE UNIVERSAL SECURITY HARD TAG AND METHOD FOR ATTACHING AND DETACHING which in turn is a continuation-in-part application which claims the benefit under 35 U.S.C. §120 of application Ser. No. 12/482,934 filed on Jun. 11, 2009 entitled SECURITY HARD TAG WITH ATTACHMENT CLIP AND METHOD FOR ATTACHING AND DETACHING which, in turn, claims the benefit under 35 U.S.C. §119 (e) of Provisional Application Ser. No. 61/157,237 filed on Mar. 4, 2009 entitled NON-FERROUS HARD TAG and of Provisional Application Ser. No. 61/163,677 filed on Mar. 26, 2009 also entitled NON-FERROUS HARD TAG and all of whose entire disclosures are incorporated by reference herein.

BACKGROUND OF THE INVENTION

1. Field of Invention

The present invention generally relates to the field of security tags, and more particularly, to hard tags which are coupled to articles.

2. Description of Related Art

Many apparel items are tagged (i.e., a security device or element applied) at the source. These security devices may comprise electronic article surveillance (EAS) elements, radio frequency identification (RFID) elements or combinations of such security devices, etc., and which can be wirelessly detected at business portals, e.g., store exits or points of sale (POS), etc. to prevent or diminish theft from the business. Most conventional hard tags on the market utilize a metallic pin and lock mechanism to secure the tag to an article (e.g., clothing) for protecting the article against theft. Once the hard tag is then installed on or with the article, to prevent any broken sewing needle from imbedding itself into the clothing and possibly causing harm to the end user, especially children, the article is subjected to a required needle detector test. The needle detector (e.g., the HN-25 Needle Detector by Hashima Co. Ltd. of Japan) senses a change in magnetic field and alarms if a ferrous metal enters into its sensing field; these detectors typically have two settings based on the quantity of iron in a steel ball of 0.8 mm (high) or 1.2 mm (low). There are also significant legal liabilities if a broken needle leaves the factory.

Conventional security tags such as EAS hang tags, sewn-in woven tags, and drop-in-pocket tags are non-ferrous, light weight, low cost, and deactivatable, but they are not visually-deterring and cannot be secured (at least in part) prior to harsh manufacturing conditions (e.g., stone-washing of jeans). Furthermore, EAS hang tags attached by a plastic strap and un-attached drop-in-pocket tags can easily be removed and are not secure.

Magnetic hard tags are visually deterring and secure (by a metal pin), but they are not non-ferrous, light weight, low cost, deactivatable, or capable of being secured prior to harsh manufacturing conditions. Rather, these tags must be removed at checkout (rather than being deactivated), and are normally secured by a metal (ferrous) pin after the object to be tagged has undergone any harsh manufacturing conditions.

In addition, the actual tagging of the security device/element to the apparel can affect the presentation of the apparel by either puncturing the apparel (e.g., pin and receptacle) or by adhering to the apparel, or by being embedded (e.g., sewn) within the apparel. Further, the weight of the tag may distort or wrinkle the fabric when the apparel is positioned on the hanger, the mannequin, or other display.

This is most apparent in many apparel items such as intimates, bathing suits and accessories but also occurs with soft goods. Soft goods include homeware items such as bedding, towels, fabrics, etc. Thus, these types of goods do not favor the known security devices and methods for attaching such devices due to the size of the goods or the invasive nature of the products known in the art. The attachment of a security device embedded in packaging for apparel, linens and soft goods is known in the art. A woven label such as that shown in U.S. Pat. No. 6,780,265 (Bleckmann, et al.) has an embedded EAS or RFID device.

The method of attaching such a woven label by a sewing machine is also known in the art. Other methods are disclosed where the device is embedded within a paper ticket, price tag or hang tag (swing ticket). These products are also attached by known methods. By way of example, see U.S. Pat. No. 5,508,684 (Becker); U.S. Pat. No. 5,583,489 (Loemaker, et al.); U.S. Pat. No. 6,254,953 (Elston); and EP 1171300 (Bleckmann, et al.). But as discussed above, sewn-in woven tags are not visually-deterring and cannot be secured (at least in part) prior to harsh manufacturing conditions.

Moreover, where RFID security devices are used, many people have an apprehension with such devices when they are used in connection with personal items because it harbors connotations of invasion of privacy. RFID security devices typically include a memory regarding the item itself. Where such security devices are sewn into apparel, people are reluctant to purchase apparel that may permanently contain a device that may store information and which cannot be removed without damaging the apparel. Thus, the use of RFID security devices tends to increase the "impact" of such security devices on apparel.

One solution, U.S. Patent Publication No. 2006/0026809 (A Ser. No. 11/237,368 filed Sep. 28, 2005), entitled "Theft Deterrent Device," which is owned by the same Assignee, namely, Checkpoint Systems, Inc., as the present application, and which is incorporated by reference herein in its entirety, discloses several embodiments, one of which (referred to as a "slotted EAS tag holder") has a housing and an attachment cable, but the attachment cable can only be attached to the article by being attached to the housing. As a result, this security tag cannot undergo harsh manufacturing conditions. In addition, this security tag does not utilize a deactivatable security element.

Another solution is that disclosed in U.S. Patent Publication No. 2010/0225485 (A Ser. No. 12/482,934, filed Jun. 11, 2009), entitled "Security Hard Tag with Attachment Clip and Method for Attaching and Detaching" and which is owned by the same Assignee, namely, Checkpoint Systems, Inc., as the present application. In particular, A Ser. No. 12/482,934 discloses a non-ferrous, light weight, low cost, secure, and visually-deterring tag; however, this tag is not deactivatable and cannot undergo harsh manufacturing conditions.

To overcome these problems, U.S. Patent Publication No. 2011/0018716 (A Ser. No. 12/887,229 filed Sep. 21, 2010) entitled "Two-Stage Universal Security Hard Tag and Method for Attaching and Detaching" and which is owned by the same Assignee, namely, Checkpoint Systems, Inc., as the present application, and which is incorporated by reference herein in its entirety, discloses a deactivatable whose working portion is not installed until after the harsh manufacturing conditions.

However, in view of the foregoing, there remains a need for a security tag that can combine the qualities of being non-ferrous, light weight, low cost, re-usable, secure, visually-deterring, and capable of being attached (at least in part) at the source (e.g., a garment factory) prior to harsh manufacturing conditions (e.g., stone washing of jeans).

BRIEF SUMMARY OF THE INVENTION

A security tag adapted for securing to an article (e.g., an article such as, but not limited to, clothing, especially children's clothing, lingerie, shoes, shirts, pants, swimwear and most outerwear, etc.) is disclosed. The security tag comprises: a housing; a releasable locking mechanism associated with the housing; an attachment clip comprising a first portion configured to secure to the article independently of the housing; and a second portion that is configured to releasably secure to the housing; and a security element (e.g., EAS (including AM, RF, EM and microwave), RFID (including LF, HF and UHF), benefit denial (e.g., ink-filled or faux dye-filled capsules) or any combination thereof, etc.) associated with the housing, and wherein the security element prevents or hinders a theft of the article.

One of the key features of the present invention is to allow the flexibility of using one housing with multiple attachment methods by just using a different low cost attachment clip. This facilitates reducing manufacturing and inventory costs also by mass producing the high cost item (i.e., the housing) while maintaining an inventory of the low cost attachment clip.

BRIEF DESCRIPTION OF SEVERAL VIEWS OF THE DRAWINGS

The invention will be described in conjunction with the following drawings in which like reference numerals designate like elements and wherein:

FIG. 15 is a cross-sectional view of the housing of the second embodiment of FIG. 12 with the second attachment clip shown coupled thereto and a portion of the belt shown in phantom;

FIG. 16 is a cross-sectional view of the second embodiment taken along line 16-16 of FIG. 15;

FIG. 17 is a cross-sectional view of the second embodiment similar to that shown in FIG. 16 but with the detacher inserted and manipulated to compress the fluke for unlocking the second attachment clip from the second embodiment;

FIG. 18 depicts the second embodiment used with a third attachment clip that uses both apertures of the second embodiment when secured to an item, e.g., a shoe;

FIG. 30 is a partial cross-sectional view of the multi-attach reusable security tag depicting a "webbed" fluke inserted therein; and FIG. 31 is a partial cross-sectional view of the multi-attach reusable security tag taken along line 31-31 of FIG. 30.

DETAILED DESCRIPTION OF THE INVENTION

Figure 1:
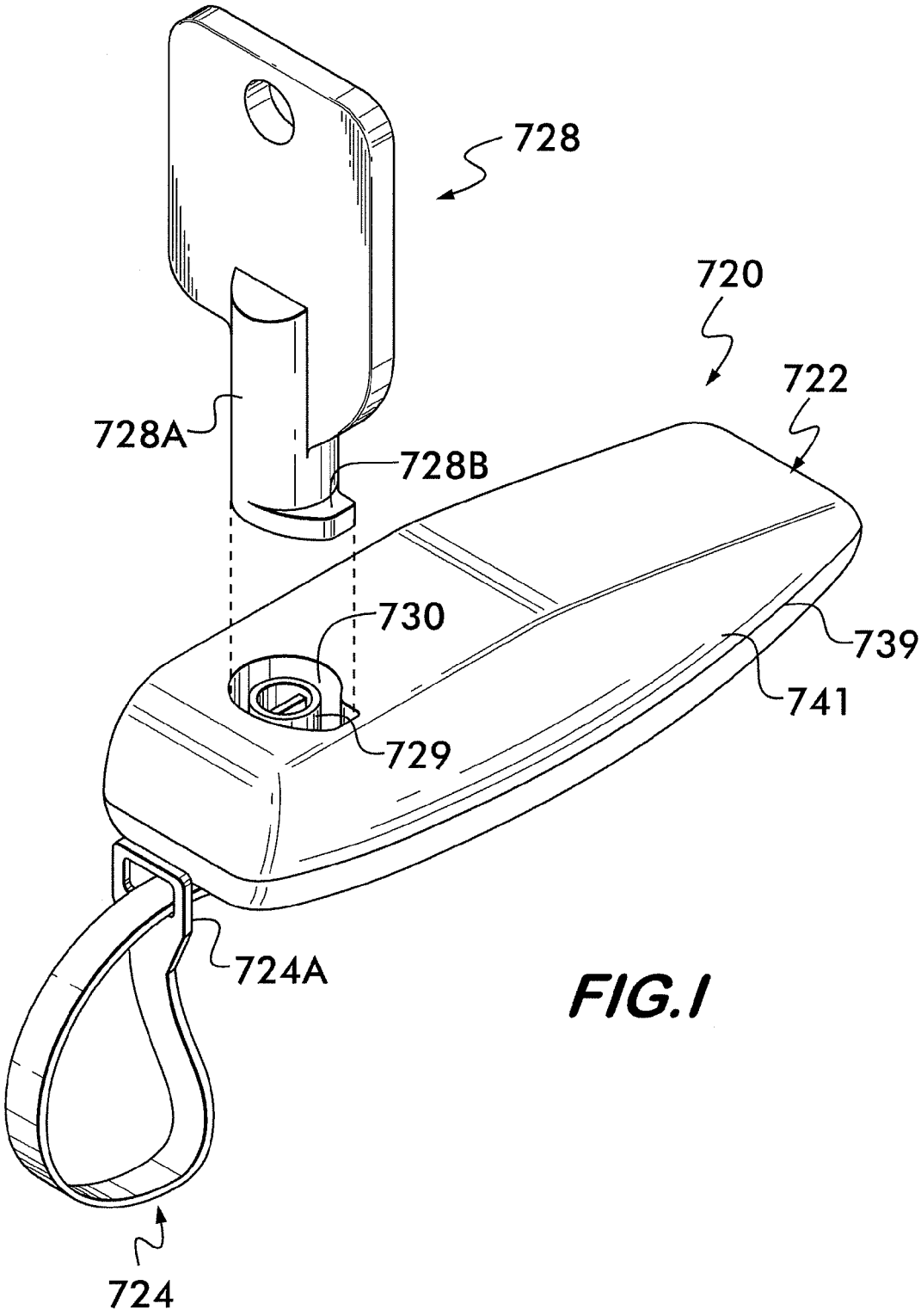
FIG. 1 is an isometric view of a reusable multi-attach security tag showing a detaching being inserted for unlocking one end of an attachment clip that couples the security tag to the item that the tag is protecting.
Figure 2:
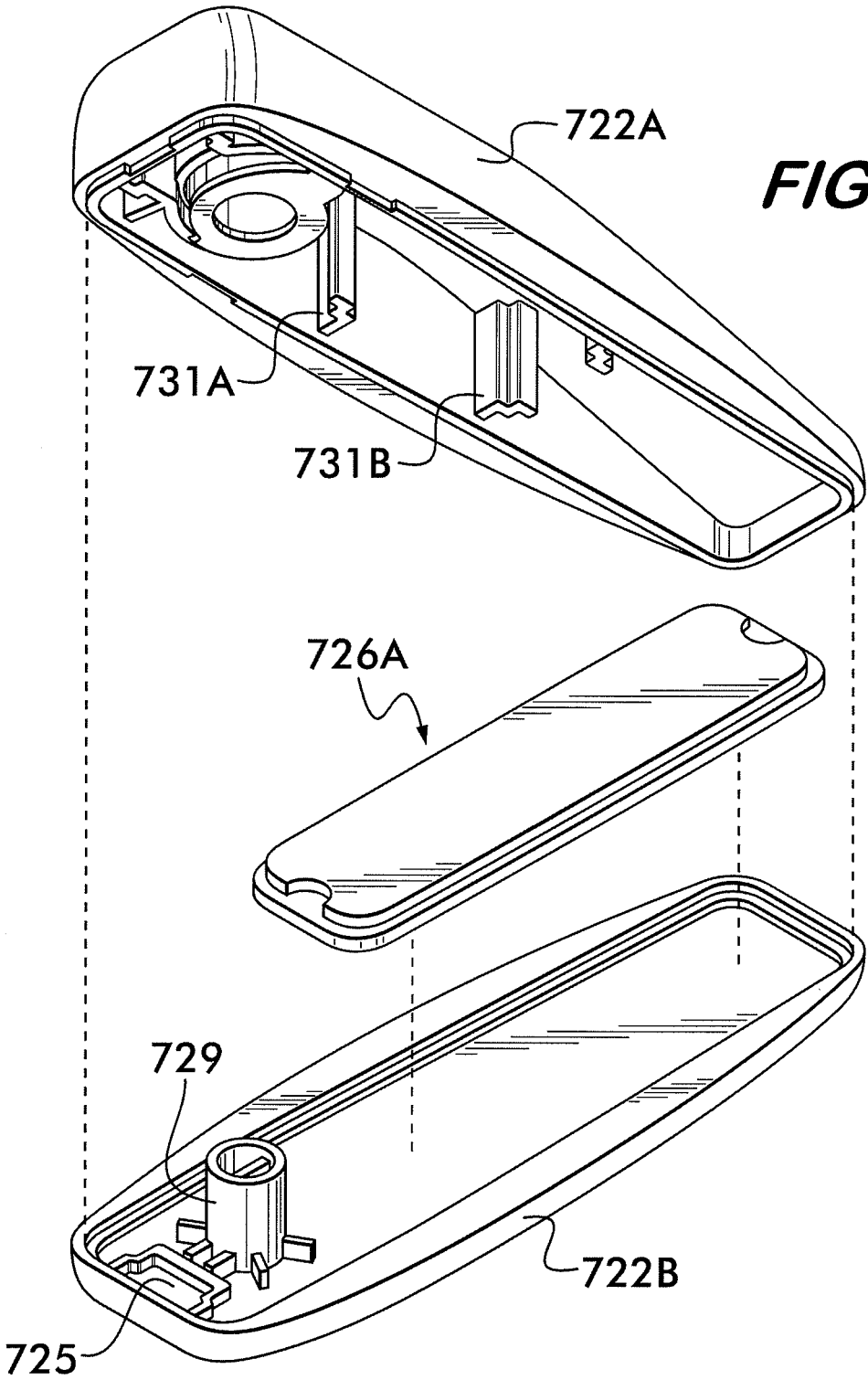
FIG. 2 is an exploded view of the housing of the reusable multi-attach security tag using, by way of example only, an acousto-magnetic (AM) security element.

The present invention provides a novel security hard tag that can be attached to a variety of items with minimal impact to the presentation of the article to potential customers of the article, reducing the weight of conventional hard tags, complying with needle tests and being versatile to include any type of security element technology such as, but not limited to: EAS (electronic article surveillance, which includes acoustomagnetic (AM), RF, EM and microwave), RFID (radio frequency identification, which includes LF, HF and UHF), benefit denial (e.g., faux ink capsules, ink-filled or dye-filled capsules that eject ink/dye upon illicit attempts to remove capsule, or visual alarm, or audible alarm or tactile alarm or any item that cannot be removed from the article (unless the article is validly purchased) that hinders or prevents the theft and/or denies the benefit of the article to the would-be thief) or any combination thereof. Therefore, whether the security element involves wireless transmissions (e.g., responding to a magnetic or electromagnetic field of a particular frequency or frequencies, or operates independently of any wireless transmissions (e.g., benefit-denial, visual/audible/tactile alarms, or anything that would draw attention to the non-authorized possession of the article, etc.), the term "security element" as used throughout the specification is meant to include any and all of these types of theft prevention-hindrance-benefit denial devices. Furthermore, it should be understood that in all of the subsequent discussion, the type of security element associated with the novel security tag forms no limitation on the invention.

The multi-attach reusable security tag (MARST) comprises a housing that contains a security element therein which, in the case where an EAS element, etc., or an RFID etc., when the housing passes an interrogator or RFID reader, emits a signal via a backscatter mechanism to provide an alert or information about itself that informs the appropriate personnel. The MARST housing includes a releasable locking mechanism that receives one end of an attachment clip that is passed through or around an article or item that is to be protected and wherein that end is then locked within the housing. At the point-of-sale (POS) or any other appropriate location where the MARST is to be validly removed from the article or item, a detacher is used by authorized personnel to disengage the one end of the attachment clip. The housing of the MARST can be reused and the attachment clip can be discarded by the purchaser or other person who is removing the article or item from the premises. Another embodiment of the MARST involves the capture of two ends of the attachment clip with one of the ends being releasable. A further embodiment of the MARST involves a "fluke element" that secures the attachment clip to the housing while allowing the attachment clip to swivel outside of the housing. The term "multi-attach" refers to the various types of attachment clip configurations that can be used with the housing, such as, but not limited to, elongated attachment clips, rounded attachment clips, split attachment clips, clamping attachment clips, etc.

All of the attachment clips comprise a non-ferrous material, preferably plastic. Moreover, all parts of the MARST housing comprise non-ferrous material, e.g., plastic. In fact, all portions, internal and external, of the housing comprise plastic (e.g., polyethylene, PVC (poly vinyl chloride) including polymers, other plastic materials, acrylonitrile-butadiene-styrene).

The shape of the MARST housing portions is shown in the figures as an elongated shape, or chevron shape, or round shape or rectangular shape but it should be understood that that is only by way of example and that an unlimited number of shapes (e.g., triangular, etc.) can be used for the housing portion. Regardless of the selected shape for the housing, the size of the housing is large enough (e.g., it has an outer dimension greater than 31.9 mm, the choking threshold standard) to avoid being a choking hazard to an infant or toddler.

As with A Ser. No. 12/887,229, one of the key features of the present invention is that any and all of the attachment clips described herein, can be initially secured to the article by itself without the MARST housing being coupled thereto. This is an important feature of the present invention because it allows an article manufacturer or assembler to only secure one portion, i.e., the attachment clip of the MARST to the article at a first location (e.g., the article manufacturing or assembly facility) while the MARST housing is secured to the attachment clip at a different second location (e.g., a retail establishment, etc.). As a result, the MASRST housing does not have to be provided to the article manufacturer or assembler. Furthermore, since the attachment clip is the only portion of the MARST attached to the article by the manufacturer or assembler, the article can be processed in its normal course which, in many circumstances, may include being subjected to harsh manufacturing environments (e.g., if the article is a pair of jeans, the harsh manufacturing environment may involve "stone-washing") to which the attachment clip is impervious or which does not interfere with the attachment clip's function. This also avoids the need to ship the MARST housing portion and similarly eliminates the potential of damaging the MARST housing during shipping to, or from, the manufacturer or assembler.

Therefore, the MARST housing is attached to the article in two stages. In the first stage, the attachment clip is attached to the article during preparation or assembly of the article. Unlike a complete security tag (e.g., one which includes a security element), this attachment clip is attached to the article before the article has been treated (e.g., if the article is a pair of jeans, the attachment clip is secured to the jeans, e.g., via a belt loop, after which the jeans are then dyed or prewashed) without suffering damage. As will be discussed in detail later, the attachment clips, such as those shown in FIGS. 1, 4, 9, 11-17, 22-29 are securely attached to the article so that they do not disengage from the article during article treatment (e.g., washing) and during shipping to their destination. In a second stage, after the article is treated and/or shipped to a presentation location (e.g. a retail environment), the MARST housing containing the security element is then attached to the attachment clip. Since the attachment clip is already secured to the article, the MARST housing can be attached quickly to the article by simply snapping the MARST housing and attachment clip together. The attachment of the MARST or housing can be accomplished at a retail establishment thousands of miles away from the article preparation facility or location. Thus, the present invention satisfies a need for a low cost, non-ferrous, lightweight, reusable or deactivatable hard tag that can be easily formed in a two stage process, namely, securing an attachment clip to the article first and then securing a housing, comprising a security element, at a later time and/or location.

Figure 3:
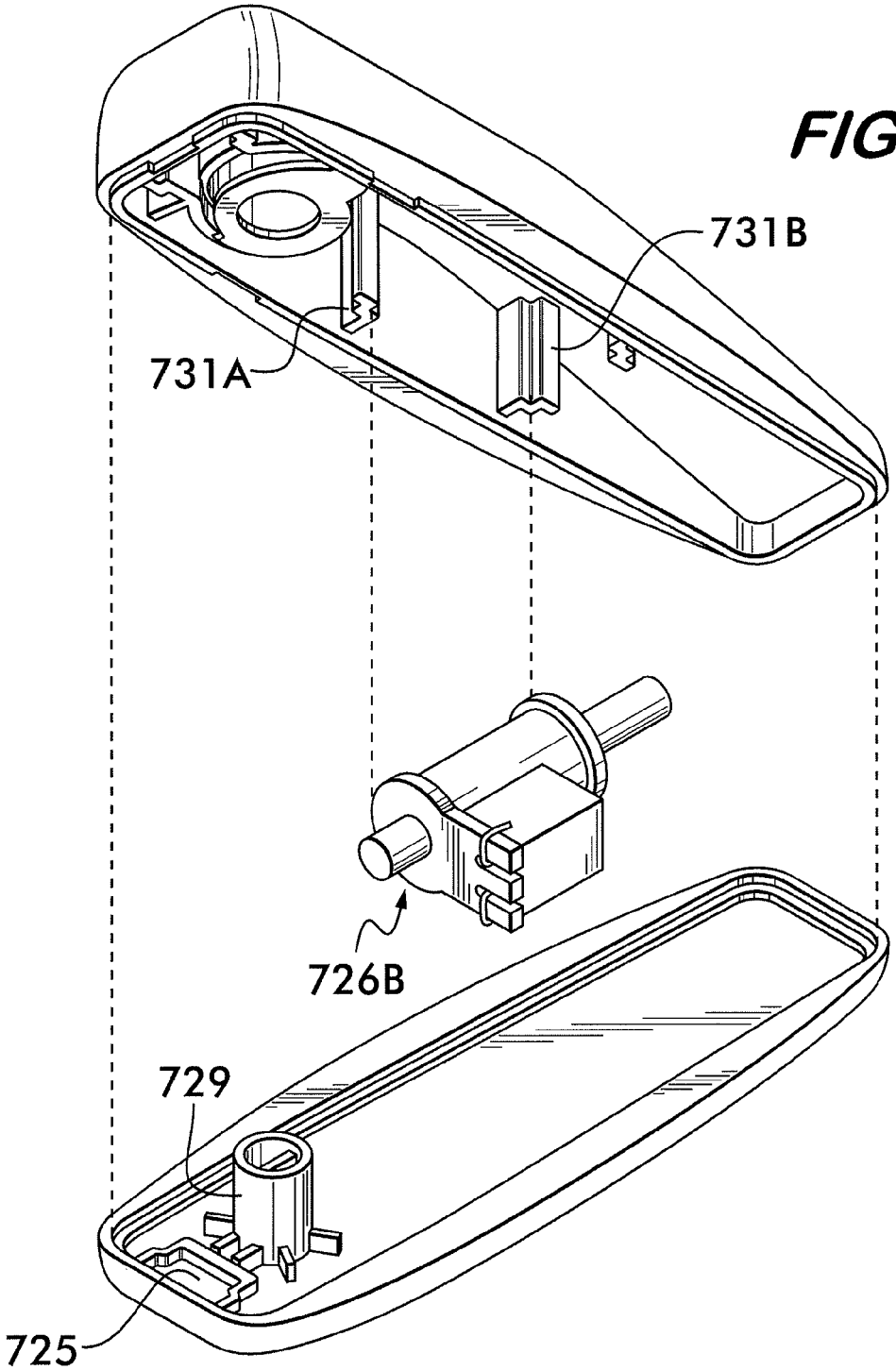
FIG. 3 is an exploded view of the housing of the reusable multi-attach security tag using a resonating ferrite coil security element, by way of example only.

By way of example only, there is shown in FIGS. 1-9 a first embodiment 720 of the MARST. The invention 720 comprises a hard tag housing 722 which comprises a first portion 722A and a second portion 722B that are fixedly secured (e.g., ultrasonically welded) together. As with previous applications, namely, A Ser. No. 12/887,229 and A Ser. No. 12/482,934, a non-metallic locking mechanism captures the end of an attachment clip 724 (FIGS. 1 and 4) which releasably secures a portion of an article (not shown) or other item. In particular, as shown most clearly in FIG. 4, the attachment clip 724 comprises two ends 724A and 724B. Only one of the two ends, namely, 724B is captured within the housing 722. The first end 724A comprises an aperture through which the second end 724B is passed and which is then inserted into an aperture 725 (see FIGS. 2 and 3) where the second end 724B locks into the housing 722. Also within the housing 722 is a security element 726A, which in FIGS. 2 and 4-7 is shown as an acoustomagnetic (AM) element by way of example only; alternatively, as shown in FIG. 3, the security element may comprise a ferrite coil 726B. It should be understood that these two types of EAS security elements are provided by way of example only and do not impose any limitation on the MARST invention; other EAS security elements are RFID security elements, or any combination thereof can also be used. Again by way of example only, the security element 726A or 726B is positioned within the second portion 722B; as can be seen most clearly in FIG. 3, a pair of alignment posts 731A/731B are provided in the first portion 722A to maintain the proper locate the ferrite coil 726A when it is used as the security element. The security element is positioned within the housing 722 to avoid any interference with the lock mechanism or with attachment clip end's 724B entry/egress during use. Thus, should a thief attempt to remove the article with the security hard tag 720 still coupled to the article, pedestals (not shown) at the retail establishment exit (also not shown) will detect the presence of an internal security element 726A or 726B and set off an alarm.

A detacher 728 (FIG. 1) is used to release the end 724B of the attachment clip 724 in order to remove the security hard tag 720 from the article that it is protecting. Possession of the detacher 728 is provided to a trusted person (e.g., store manager or employee, etc.) who inserts it into an opening 730 in the security tag 720 and then rotates the detacher 728 to release the end 724B of the attachment clip 724, as will be discussed later. The detacher 728 comprises a shank 728A at whose distal end is a cam 728B. Furthermore, the second portion 722B includes a central post 729 over which the shank 728A of the detacher 728 is inserted and is rotatably movable about the post 729. The cam 728B interacts with a portion of the attachment clip end 724B to release the end 724B of the attachment clip 724 and to permit the security hard tag 720 to be released from the article or item. It should be understood that although the detacher 728 is shown in the figures as a "key-style" configuration that only indicates a portion of the overall detacher and specifically the figures only depict the portion of the detacher 728 that engages the invention 720. Thus, the detacher 728 may comprise a component that is fixedly secured at the point of sale (POS) and which includes a portion that is shown in the figures of this Specification for engaging the invention 720 when removal of the invention from the article is to be accomplished. In addition, a lever or other type of mechanism or automated mechanism may be used to activate the detacher 728 when engaged with the invention 720 to release it from the article.

Figures 4, 5, 6:
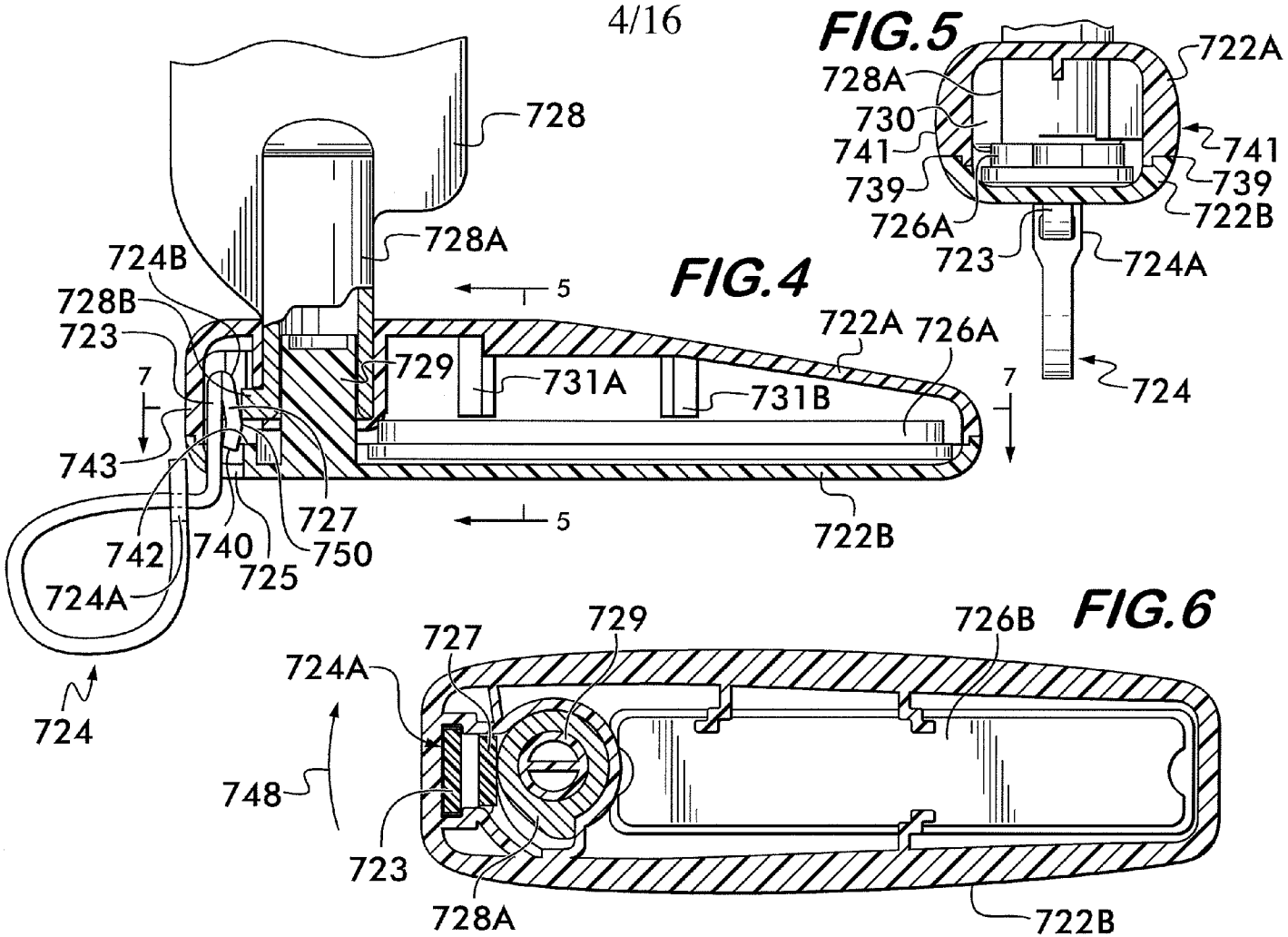
FIG. 4 is a partial cross-sectional view of the reusable multi-attach security tag of FIG. 1 showing the detacher inserted into the housing and compressing the fluke end of the attachment clip, thereby permitting the release of that end of the attachment clip from the housing.
FIG. 5 is a cross-sectional view of the housing of the reusable multi-attach security tag taken along line 5-5 of FIG. 4.
FIG. 6 is a cross-sectional view of the housing of the reusable multi-attach security tag of FIG. 1 showing the fluke in an uncompressed "locked" condition.
Figure 8:
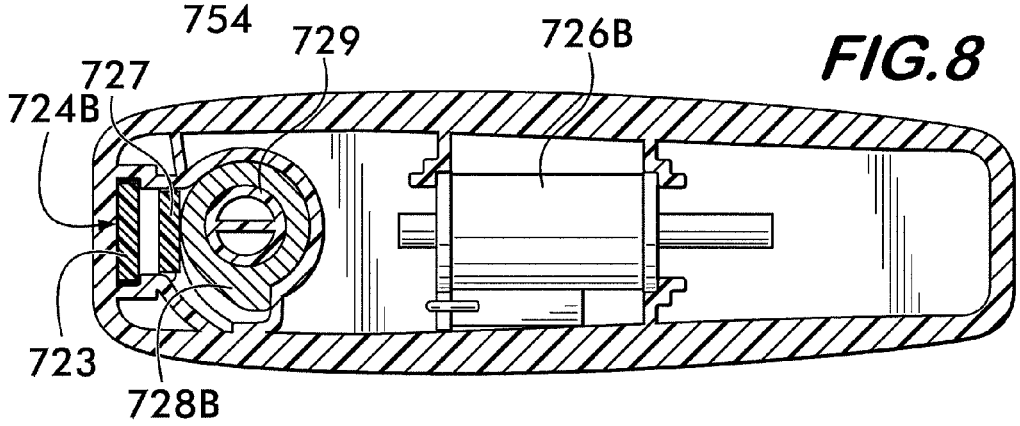
FIG. 8 is a view similar to FIG. 6 but wherein the ferrite coil security element is used.

The attachment clip 724, as well as the housing 722, are plastic. In fact, all portions, internal and external, of the housing 722, i.e., the first portion 722A and the second portion 722B comprise plastic (e.g., polyethylene, PVC (poly vinyl chloride) including polymers, other plastic materials, acrylonitrile-butadiene-styrene). In the preferred embodiment, there are no ferrous materials contained within or outside of the invention 720 and thus the locking mechanism of the housing 722 is formed of plastic. The second end 724B of the attachment clip 724 comprises a bent or "hooked" configuration which is hereinafter referred to as a "fluke". The fluke comprises a stem 723 and a barb 727 (FIG. 4). As the fluke 724B is slid through the aperture 725, the barb 727 is initially compressed as it passes through the opening 725 and then flexes open again such that the extreme end of the fluke, barb edge 740, is locked against a stop 742 in the second portion 722B. FIGS. 6 and 8 show the locked condition of the fluke 724B within the second portion 722B. As also shown in FIG. 4, an aperture wall 743, along with the stop 740 thickness (e.g., approximately ½ inch), form a fluke support that resists the deformation of the fluke 724 should a would-be thief attempt to pull or tug on the attachment clip 724 to disengage it from the housing 722.

Figure 7:
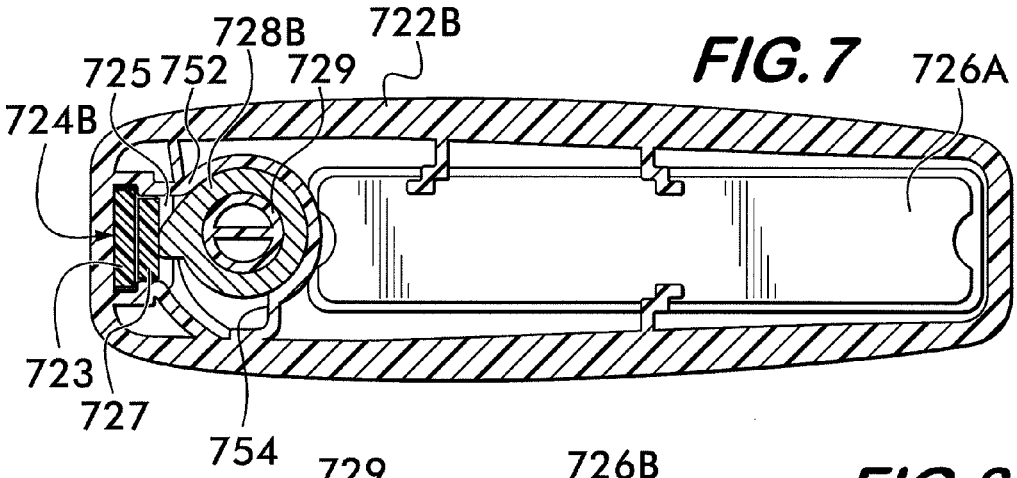
FIG. 7 is the same view as shown in FIG. 6 taken along line 7-7 of FIG. 4 showing the detacher compressing the fluke, thereby unlocking the attachment clip.

FIGS. 4 and 7 also depict how the security hard tag 720 is released from the article (not shown) to which the tag 720 is secured. When the detacher 728 is inserted into the opening 730, over the central post 729, and then rotated in the direction 748 (FIG. 6), the cam 728B compresses the fluke barb 727 (as shown in FIGS. 4 and 7), causing it to temporarily deform to permit passage of the fluke 724B out of the opening 725 of the housing 722. It should be further noted that because the fluke 724B contains a bridge line 750 between two non-aligned segments of the barb 727, when the cam 728B pushes against that bridge line 750 during rotation of the detacher 728, the fluke 724B is not simply compressed but is compressed and driven partially out of the opening 725, thereby allowing the trusted person to grip the released fluke 724B and disengage it from the housing 722, thereby release the security hard tag 720 from the article (not shown) to which it had been attached. FIG. 4 depicts this "popped out" condition after the cam 728B has compressed the fluke 724B along the bridge line 750. This feature of not only unlocking the fluke 724B but partially "popping" it out from the opening 725, permits the trusted person to conceal the insertion of the detacher 728 when releasing the security hard tag 720 and then to manually completely pull out the released fluke 724B to release the article attached thereto. For example, when an article is validly purchased at the POS, the trusted person can place the article (with the security hard tag 720 attached thereto) under the POS counter, where he/she inserts the detacher 728 (out of the view of the customer) into the opening 730, rotates it and then "feels" the released fluke 724B, removes the detacher 728 and then brings everything back into view of the customer where the trusted person moves the attachment clip 724 slightly to release the security hard tag 720 from the purchased article. The customer thus never has an opportunity to see what the trusted person used to release the attachment clip 724. The security hard tag 720 can then be attached to a new article.

As mentioned earlier, FIG. 7 is a cross-sectional view of the security hard tag 720 looking down through the second portion 722B showing the cam 728B compressing the fluke 724B. In particular, with the cam 728B compressing the fluke 724B, the cam 728B is prevented from over-travelling and releasing the fluke 724B by a stop 752. Similarly, to prevent the cam 728B from being rotated in the opposite direction when it is first inserted, there is a stop 754. Therefore, upon insertion of the detacher 728, these stops provide tactile indicators for the trusted person to quickly insert the detacher 728 and release the security hard tag 720.

It should be noted that when the two portions 722A/722B are fixedly secured together the seam 739 is positioned along a "rounded" edge 741 (see FIGS. 1 and 5). This rounded edge prevents a would-thief from trying to stand up the housing 722 along that edge and then try to stomp on it or otherwise strike the housing 722 to open the seam 739.

Figure 9:
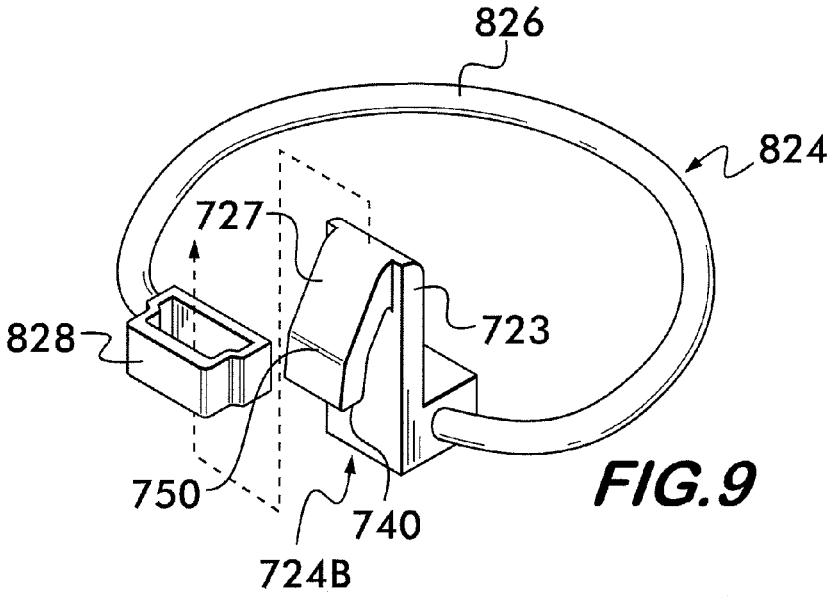
FIG. 9 shows an alternative "round open" attachment clip.

As mentioned earlier, the attachment clip 724 is by way of example only. FIG. 9 shows another exemplary attachment clip 824 that can be used with the security hard tag 720. The alternative "round open" attachment clip 824 comprises the fluke 724B but includes a curved body or arcuate tether 826 and aperture 828 at the other end. Thus, to use the round open attachment clip 824, the user would pass the aperture 828 or fluke 724B around or through the article (not shown) and then the fluke 724B is the compressed and passed through the aperture 828 (as shown in FIG. 9) and then into the opening 725 of the housing 722.

Figure 14:
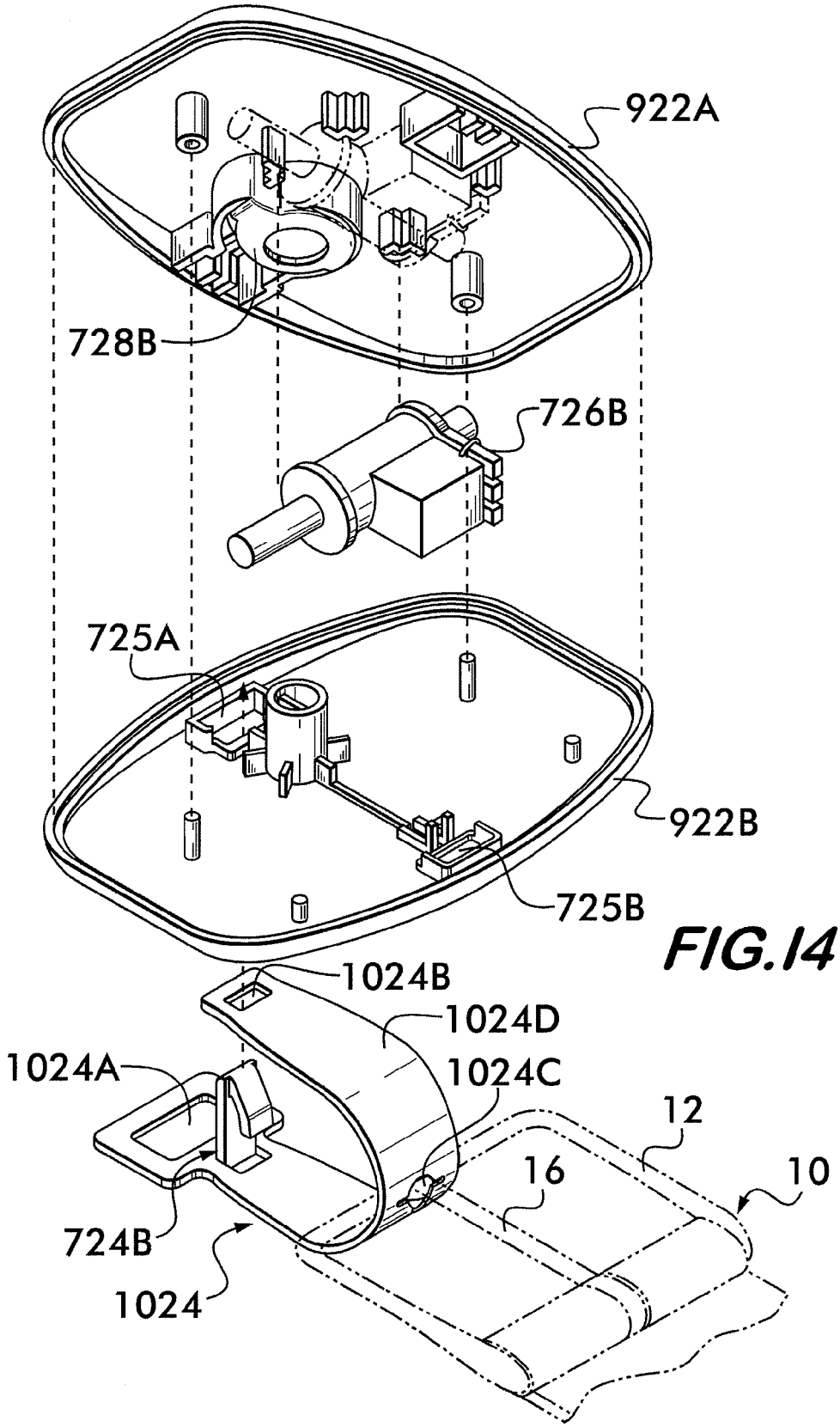
FIG. 14 is an exploded view of the second embodiment of FIG. 13 but showing a ferrite coil as the internal security element rather than the AM security element.

A second embodiment 920 of the MARST is shown in FIGS. 10-19 which includes a pair of apertures 725A and 725B (FIGS. 12-14) for accommodating one or two ends of an attachment clip while showing its exemplary use with a belt, shown partially. Again, the security element that may be contained therein imposes no limitation on the invention and may include, by way of example only, an AM element 726A (FIGS. 13, 15-16 and 19) or a ferrite core element 726B (FIG. 14). The second embodiment housing 922 also comprises two portions 922A and 922B, as shown most clearly in FIG. 13, which are also fixedly secured (e.g., ultrasonically welded) together.

Figure 12:
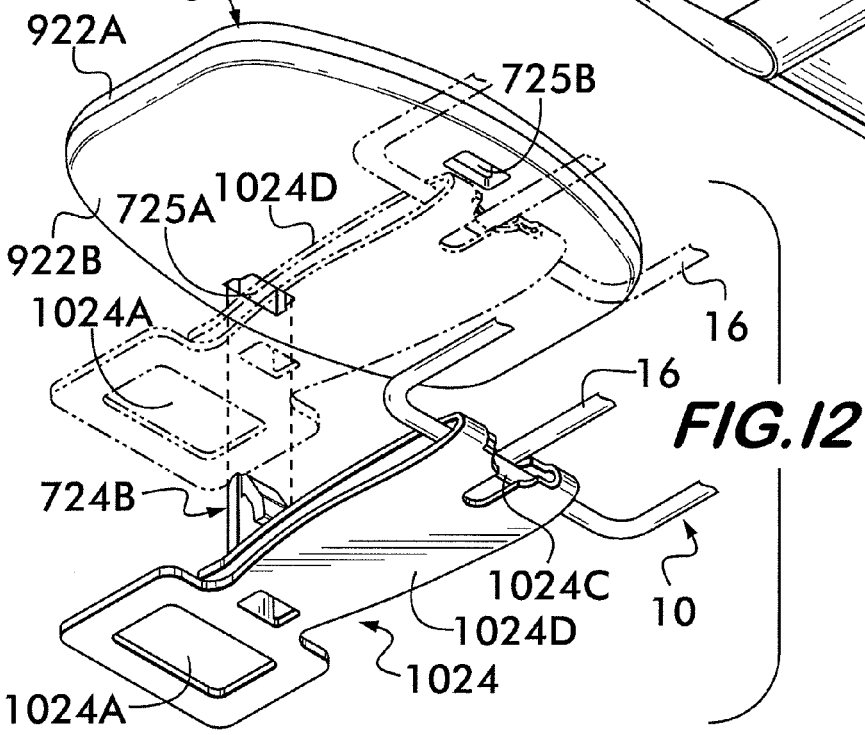
FIG. 12 is an isometric view showing how an second attachment clip is coupled to the second embodiment, with the second attachment clip being shown in phantom when attached to the second embodiment.
Figure 13:
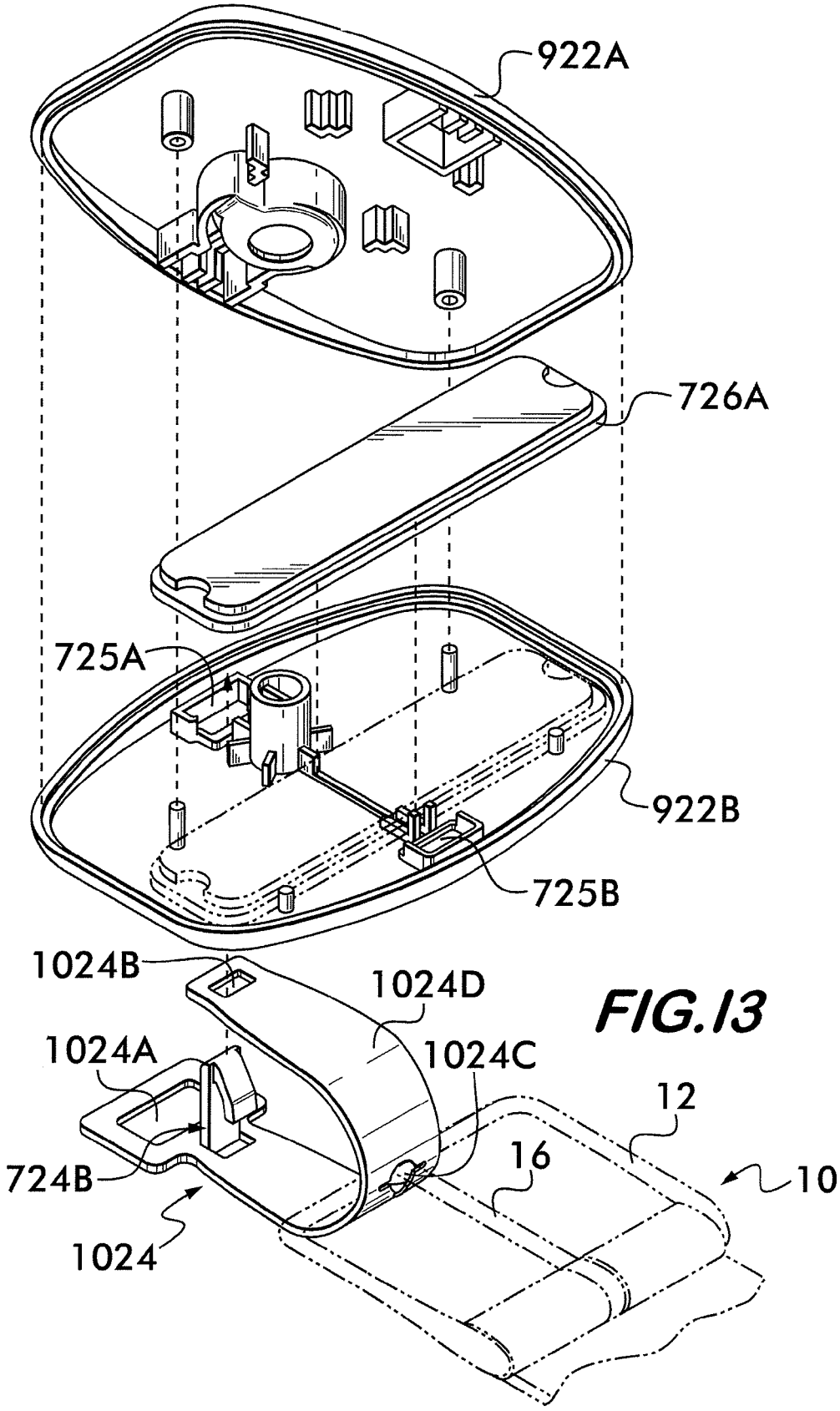
FIG. 13 is an exploded view of the second embodiment showing an AM security element and how the second attachment clip attaches to the second embodiment with the belt being shown in phantom.

Use of the second embodiment 920 with a belt article requires the use of only aperture 725A because the attachment clip 1024 includes the sole fluke 724B (e.g., FIG. 12). In contrast, as will be discussed later, the second embodiment 920 may be used with a different attachment clip 1124 (FIGS. 18-19) wherein both ends of the attachment clip 1124 are inserted into the housing 922 when used with a different article, e.g., a shoe 18. What should be understood is that the locking mechanism controls the release of only one of the ends of the attachment clip. Thus, it is necessary to differentiate the two apertures 725A and 725B from each other. One exemplary way to do this is to "key" the apertures differently. As can be most clearly in FIGS. 12-14, aperture 725A has a "broadened-T" appearance whereas aperture 725B simply has a rounded rectangular appearance. The user of the device is notified ahead of time that only the end of the attachment clip that is inserted into aperture 725A (i.e., broadened-T appearance) can be released by the detacher 728.

It should be further noted that that this "keying" feature of the aperture has another purpose and that is to also prevent the fluke 724B from being inserted incorrectly. By way of example only and as can be seen most clearly in FIG. 23, the fluke 724B has a wide element 724C and a more narrowed barb width 724D. These two features form a contour or shape that corresponds directly to the contour or shape of the aperture 725. This guarantees that the fluke 724B is inserted into the aperture 725 as shown in FIG. 4 with the barb 727 facing the detacher cam 728B, thereby allowing the cam 728B to compress the barb 727 during release. If, on the hand, there was no keying feature, then the fluke 724B could be inadvertently inserted with the barb 727 facing away from the cam 728B, and thus the cam 728B would not be able to compress the barb 727 in order to release the attachment clip 724.

Figure 10:
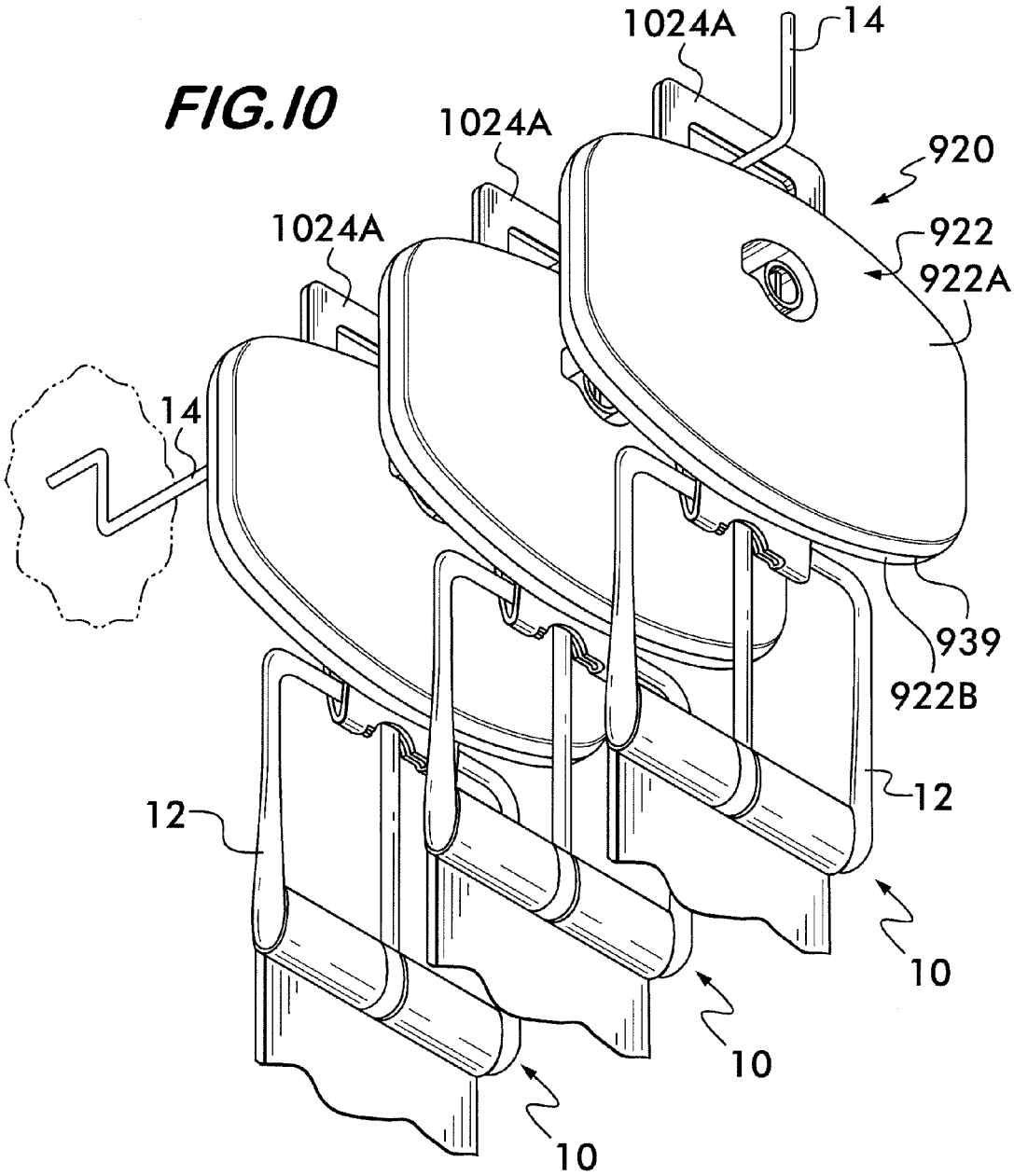
FIG. 10 shows a second embodiment of the reusable multi-attach security tag that includes a pair of apertures (see FIG. 12) for accommodating one or two ends of an attachment clip while showing its exemplary use with a belt, shown partially.
Figure 11:
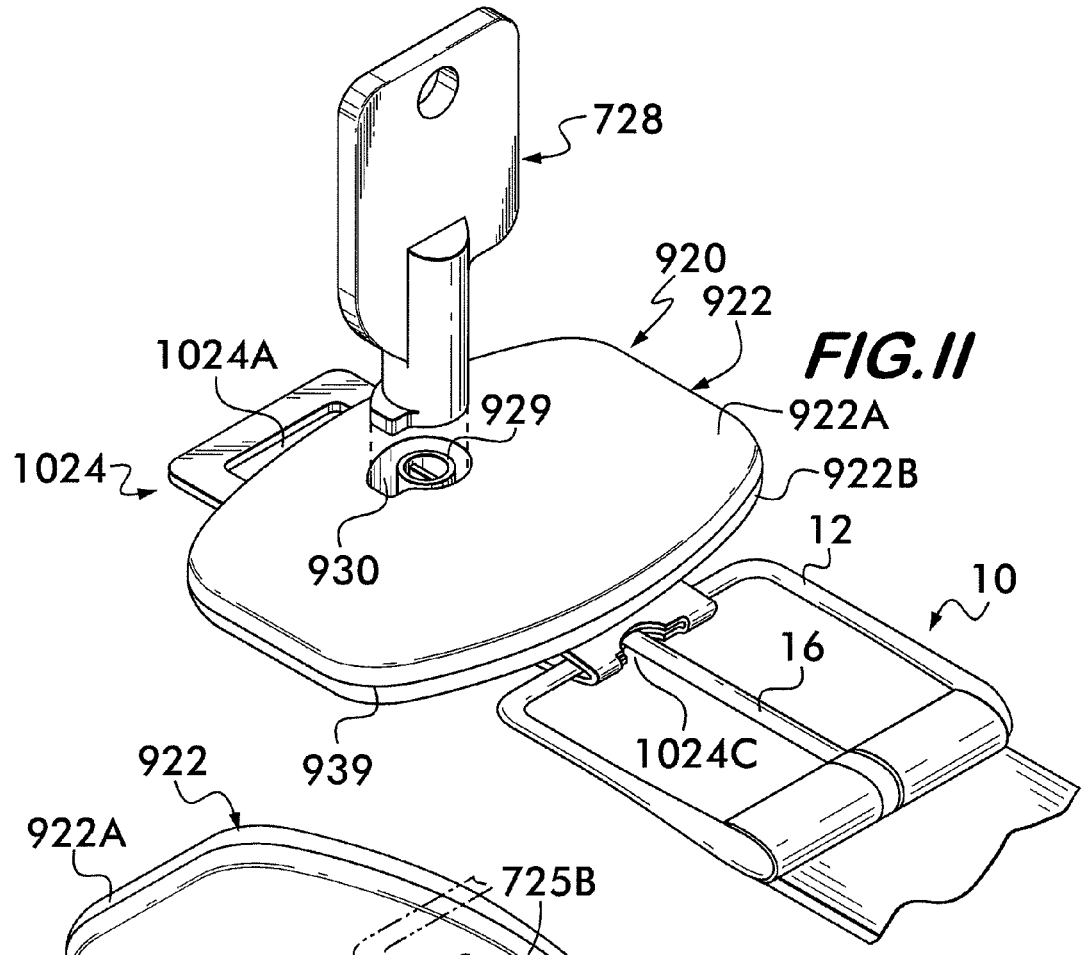
FIG. 11 is an isometric view of the second embodiment showing the detacher being inserted into the reusable multi-attach security tag.

As mentioned previously, FIGS. 10-17 show the second embodiment 920 using the attachment clip 1024. This attachment clip 1024 is designed for use with belt articles 10 and in particular, the buckle portion 12 of the belt 10. Use of this attachment clip 1024 with the second embodiment 920 provides for a uniform presentation of belt merchandise with a security tag as shown in FIG. 10 where the belt products with their respective security tags are shown mounted on a store display rack prong 14. In particular, the attachment clip 1024 comprises a first hanging aperture 1024A, a second aperture 1024B, the fluke 724B, a third aperture 1024C and a body 1024D. The third aperture 1024C is positioned approximately in the center of the body 1024D. To use this attachment clip 1024, as shown most clearly in FIG. 13 or 14, the user first passes one of end of the attachment clip 1024 through the buckle portion 12 and then inserts the prong 16 portion of the belt 10 through the third aperture 1024C. The body 1024D of the attachment clip 1024 is folded and the fluke 724B is pushed through the second opening 1024B and then the fluke 724B is inserted into the housing aperture 725A, as shown in FIG. 12. The assembly can then be hung on the display rack prong, as shown in FIG. 10. To release the security tag 920 from the belt 10, the same lock mechanism operation is used, as that described in the first embodiment. In particular, FIG. 10 shows the detacher 728 being inserted into a housing opening 930 and over a post 929. The detacher 728 is then rotated and the fluke 724B is compressed (see FIG. 17), thereby releasing the fluke 724B and permitting the authorized store personnel to remove the fluke 724B, disengaging the attachment clip from the housing 922. The attachment clip body 1024D is then unfolded by pulling the aperture 1024B off from the fluke 724B and then disengaging the prong 16 from the third aperture 1024C.

As can be appreciated, if the fluke 724B of the attachment clip 1024 were inadvertently inserted into the aperture 725B, there would be no way to release the fluke 724B, since the lock mechanism only can interact with a fluke inserted into aperture 725A.

Figure 19:
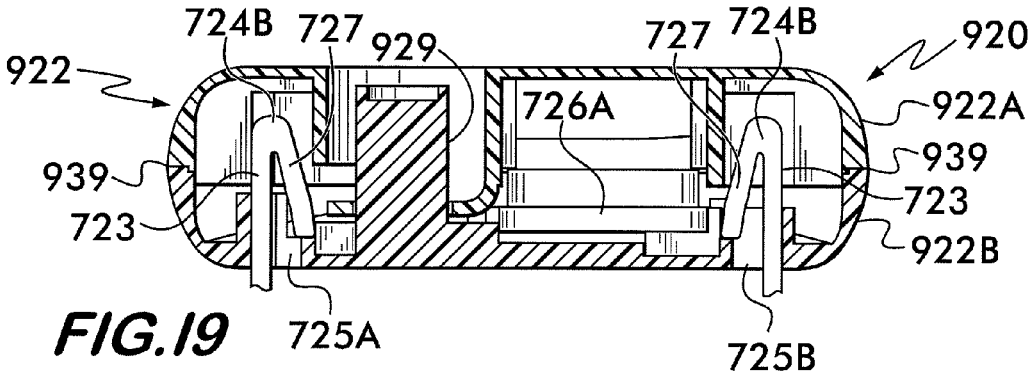
FIG. 19 is a cross-sectional view of the second embodiment of FIG. 18 taken along lines 19-19 of FIG. 18.

FIGS. 18-19 depict the use of the second embodiment 920 using the attachment clip 1124 (e.g., 240 mm flexible strap) which comprises the fluke 724B at each end (see FIG. 19). Thus, when both ends of the attachment clip 1124 are inserted into their respective apertures 725A and 725B, only the fluke 724B located in aperture 725A can be released when the detacher 728 (not shown in FIG. 19) is inserted. In that instance, the second embodiment 920 can be re-used but only with that particular attachment clip 1124 since the fluke 724B inserted into aperture 725B is permanently trapped within.

As can also be seen in FIG. 19, the sides of the housing 922 are rounded to also prevent a would-be thief from attempting to stand the housing on either side where a seam between the two portions 922A/922B is present and attempting to stomp on it or otherwise strike the housing 922 to open the seam 939.

Figure 20:
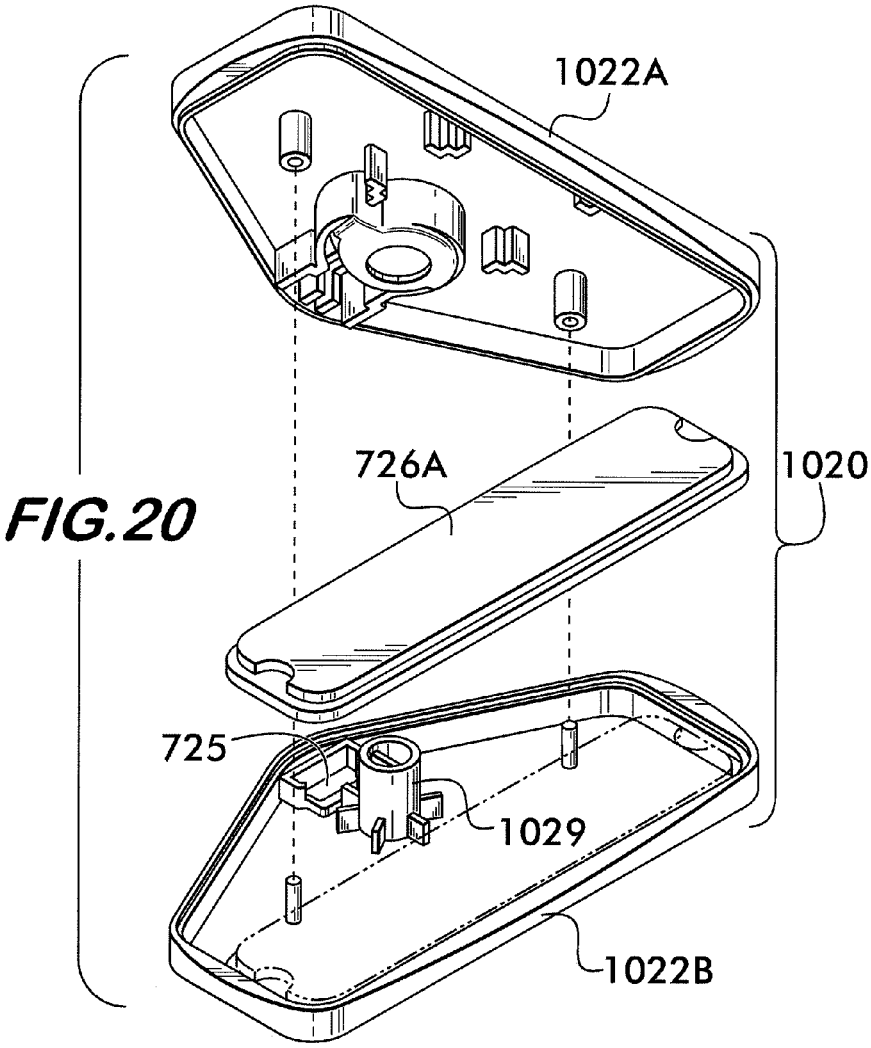
FIG. 20 is an exploded view of a third embodiment of the present invention that uses an AM security element and which operates similarly to the first embodiment but is chevron-shaped.
Figure 21:
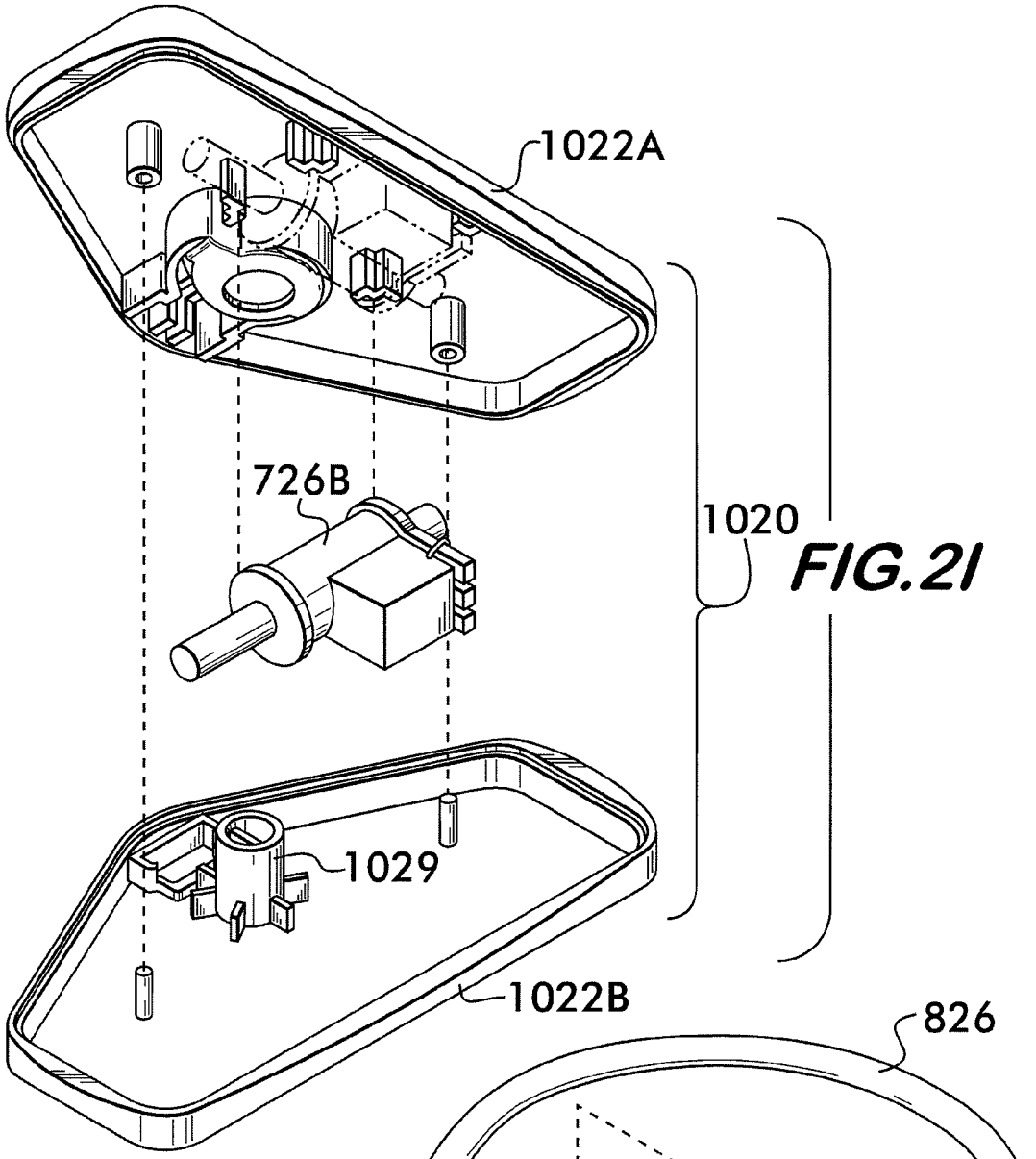
FIG. 21 is an exploded view of the third embodiment of the present invention that uses a ferrite coil security element and which operates similarly to the first embodiment.
Figure 22:
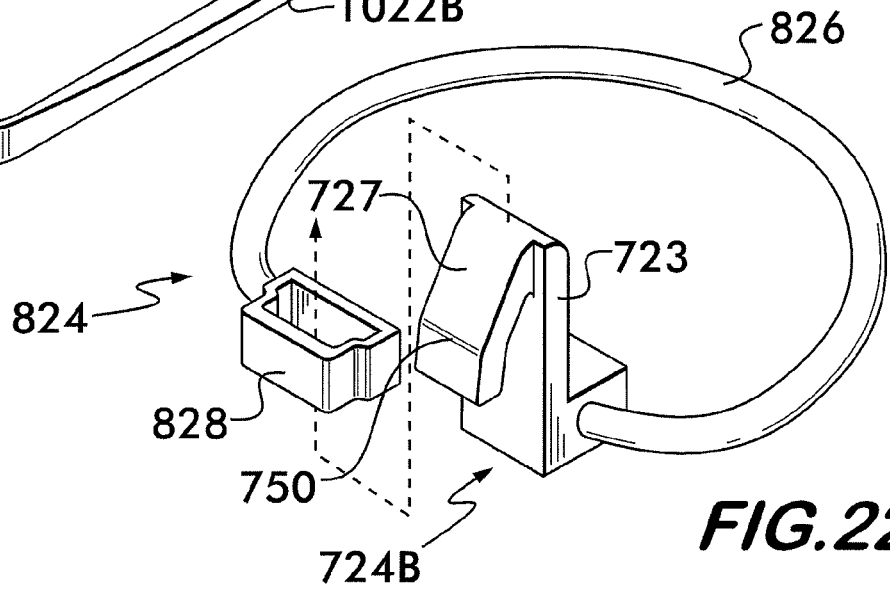
FIG. 22 shows the "round open" attachment clip which may be used with the third embodiment.

FIGS. 20-21 show a third embodiment 1020 of the MARST that has a "chevron-shaped" housing 1022 comprising a first portion 1022A and a second portion 1022B that are fixedly secured (e.g., ultrasonically welded) together. As mentioned previously, the security element that may be contained therein imposes no limitation on the invention and may include, by way of example only, an AM element 726A (FIG. 20) or a ferrite core element 726B (FIG. 21). Operation of this third embodiment 1020 is identical to the first embodiment 720 with regard to the locking mechanism as well as the use of a variety of attachment clips and, by way of example only, the round open" attachment clip 824. Although the detacher 728 is not shown, insertion of the detacher 728 would be over a post 1029 shown in FIGS. 20-21.

FIGS. 23-29 depict the MARST embodiment 720 (by way of example only; any of the MARST embodiments could be used) used with an attachment clip that can rotate or swivel externally of the tag housing. This feature is important to prevent would-be thieves from trying to "twist-off" the attachment clip from the housing, as well as providing the retail establishment the ability to manipulate the MARST embodiment while on the article to provide a nice display or presentation.

Figure 23:
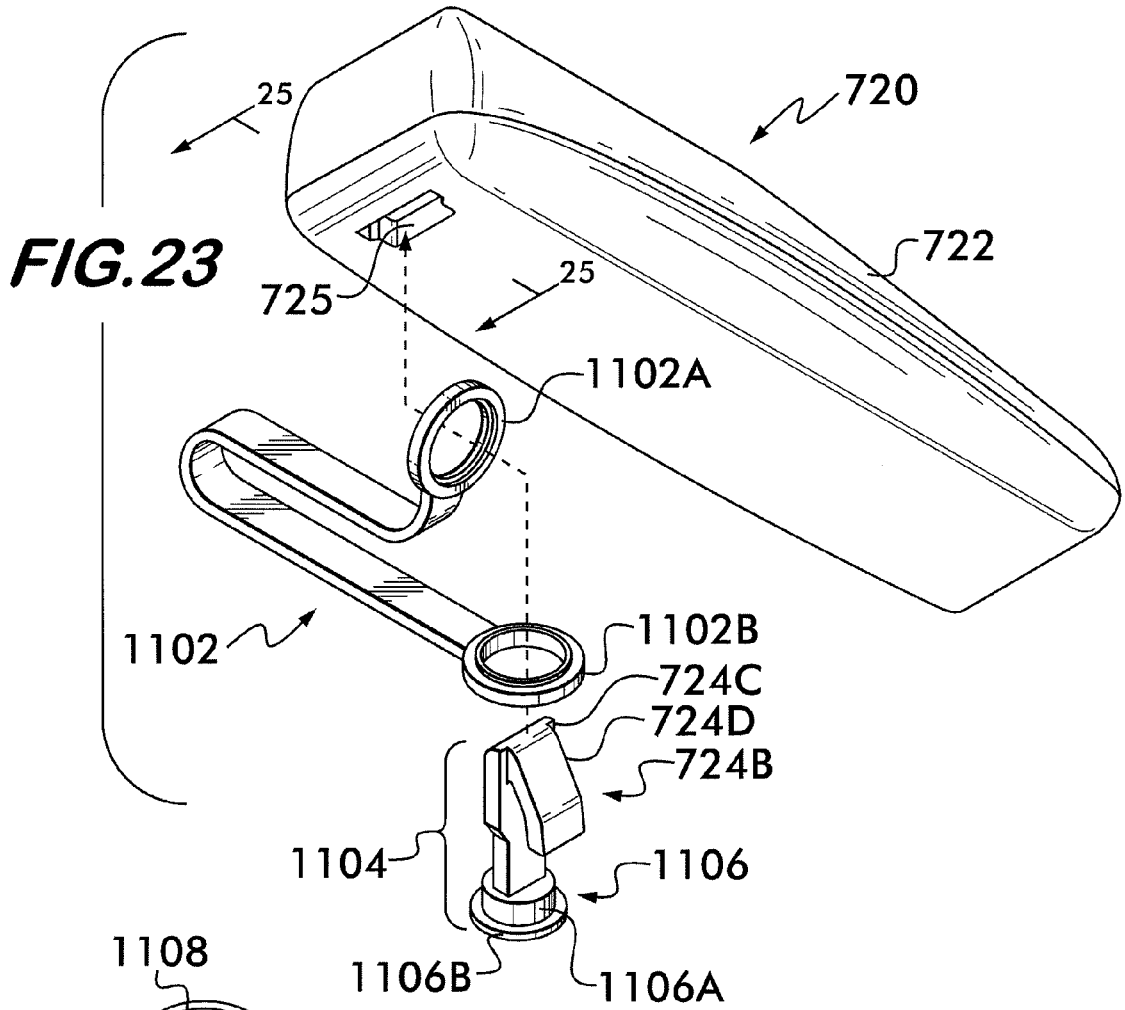
FIG. 23 is an isometric view of the multi-attach reusable security tag using an attachment clip that can externally rotate during use with an article.

In particular, FIG. 23 depicts an attachment clip 1102 having apertured ends that nest when the attachment clip 1102 is folded so that the apertures of the ends 1102A and 1102B are aligned. In addition, a fluke element 1104 (also referred to as a "connecting element") secures the attachment clip 1102 to the housing 722. The fluke element 1104 comprises the fluke 724B at one end and an end cap 1106 at the other end. The end cap 1106 comprises a "top hat" configuration having an inner cylindrical element 1106A and a circular flange 1106B. The circular flange 1106B has an area that is greater than the apertures of the ends 1102A and 1102B so that when the fluke 724B is passed through the aligned apertures, the ends 1102A and 1102B are trapped against the circular flange 1106B. When the two ends 1102A/1102B of the attachment clip 1102 are nested, their apertures are aligned so that they can slide over the fluke element 1104 and the nested ends 1102A/1102B are free to rotate about the inner cylindrical element 1106A, being trapped between the housing 722 and the circular flange 1106B when the fluke 724B is inserted into the housing aperture 725 and locked therein, as shown most clearly in FIG. 41.

Figure 24:
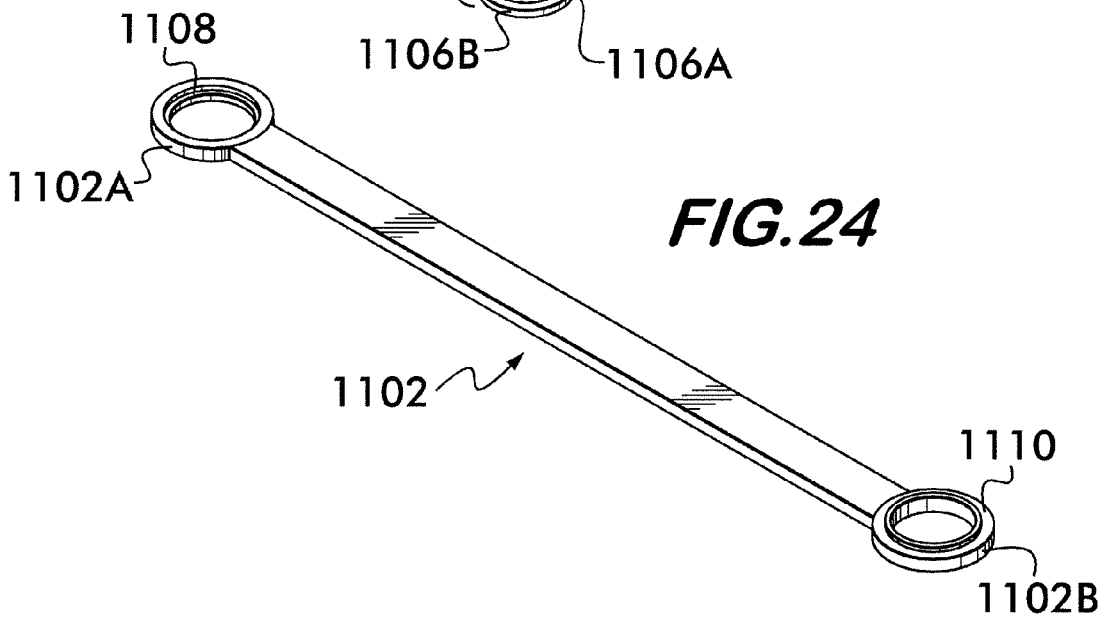
FIG. 24 is an isometric view of the attachment clip used in FIG. 23.

FIG. 24 shows the attachment clip 1102 in an unfolded condition, showing the recess 1108 in the end 1102A that mates with the collar 1110 in the end 1102B to allow these ends 1102A/1102B to "nest".

Figure 25:
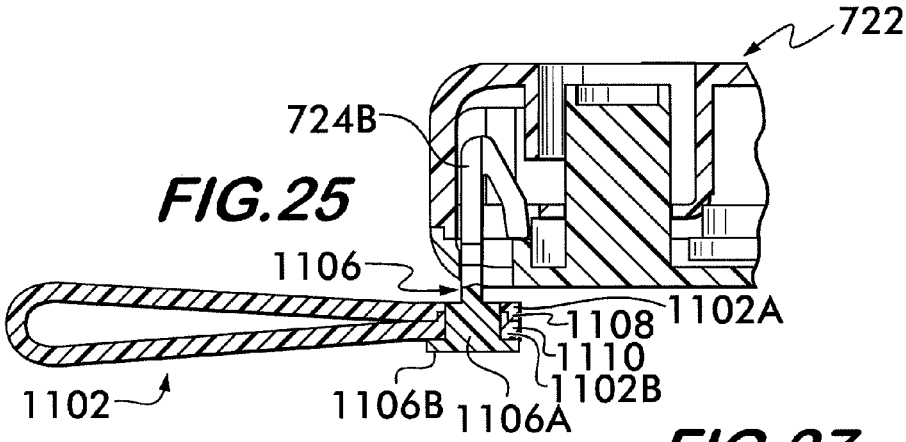
FIG. 25 is a partial cross-sectional of the multi-attach reusable security tag showing the attachment clip secured thereto taken along line 25-25 of FIG. 23.

FIG. 25 is a cross-sectional view taken along line 25-25 of FIG. 23 showing the fluke element 1104 locked within the housing 722 and how the attachment clip 1102 can freely rotate around the end cap 1106. Therefore, once the attachment clip 1102 is looped around or through an article and then folded (as shown in FIG. 23), the ends 1112A/1112B are nested and then the fluke element 1104 is passed through the apertures of the nested ends 1102A/1102B and the fluke element 1104 is passed through the apertures of the nested ends 1102A/1102B and the fluke 724B is inserted into the housing aperture 725 and locked, as shown in FIG. 25.

Figure 26:
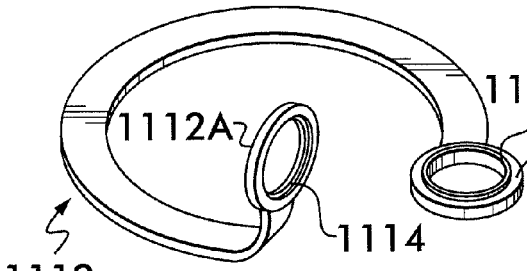
FIG. 26 is an isometric view of another attachment clip that can externally rotate during use with an article.
Figure 27:
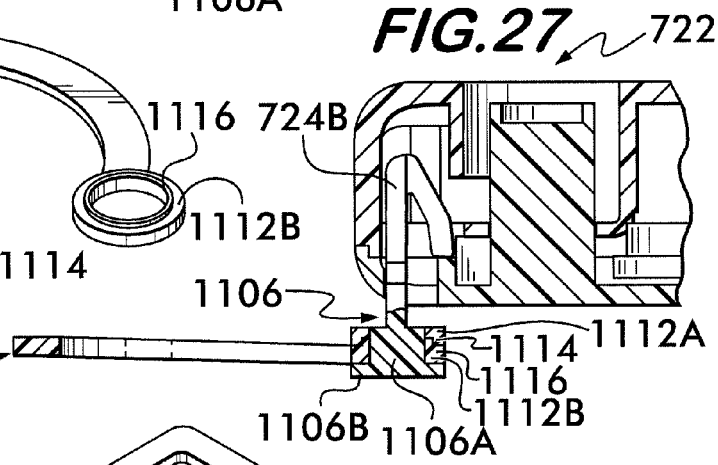
FIG. 27 is a partial cross-sectional of the multi-attach reusable security tag showing the attachment clip secured thereto taken along line 25-25 of FIG. 23 but using the attachment clip of FIG. 26.
Figure 28:
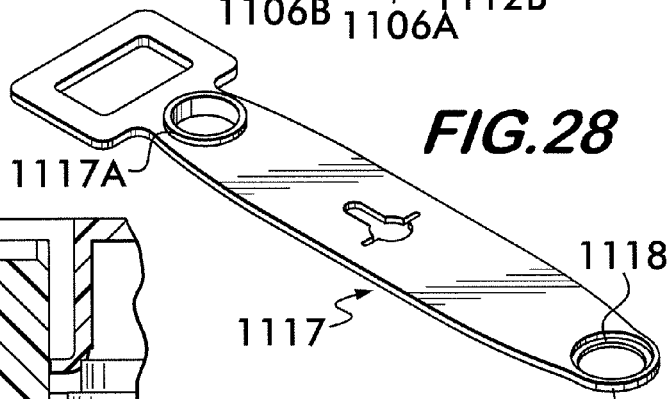
FIG. 28 is an isometric view of an attachment clip similar to the attachment clip of FIGS. 10-17 but wherein the fluke is a separate element.

FIG. 26 shows another attachment clip 1112, namely, a "round open" swivelable attachment clip which also comprises a pair of ends 1112A and 1112B having respective apertures and whereby the ends 1112A/1112B nest. The recess 1114 in the end 1112A mates with the collar 1116. Thus, once the attachment clip 1112 is looped around or through an article, the ends 1112A/1112B are nested and then the fluke element 1104 is passed through the apertures of the nested ends 1112A/1112B and the fluke 724B is inserted into the housing aperture 725 and locked, as shown in FIG. 27. The attachment clip 1112 is now free to rotate about the fluke element 1104.

It should be understood that the terms "swivelable" and "rotatable" are interchangeable as used throughout this Specification.

Figure 29:
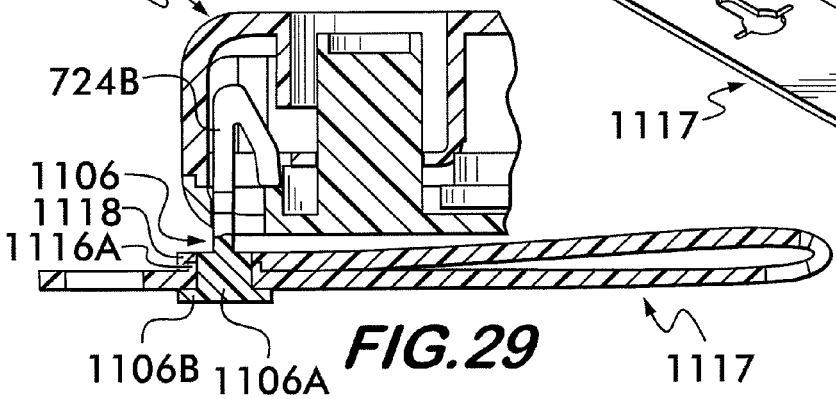
FIG. 29 is a partial cross-sectional of the multi-attach reusable security tag showing the attachment clip of FIG. 28 secured thereto and taken along line 25-25 of FIG. 23.

The swivelable attachment clip 1117 (FIGS. 28-29) is identical to the attachment clip 1024 mentioned previously but the fluke 724B of the attachment clip 1024 has been replaced with a collar 1117A having an aperture and the second aperture 1024B has been replaced with end 1117B that has a recess 1118. Thus, when the attachment clip 1117 is folded for use with a belt product (as discussed previously), the collar 1117A and the recess 1118 mate, resulting in their respective apertures being aligned. Thus, once the attachment clip 1117 is coupled to the belt article as discussed previously, the recess 1118 and collar 1117A are nested and then the fluke element 1104 is passed through the apertures of the nested elements 1118/1117A and the fluke 724B is inserted into the housing aperture 725 and locked, as shown in FIG. 29. The attachment clip 1117 is now free to rotate about the fluke element 1104. Thus, the attachment clip 1117 is swivelable or rotatable continuously about the fluke element 1104.

To further enhance the strength of the fluke 724B, FIGS. 30-31 illustrate a fluke 724B that is "webbed". In particular, as shown most clearly in FIG. 31, a web 1120 fills a portion of the gap between the stem 723 and the barb 727 of the fluke 724B. The web 1120 also comprises plastic (e.g., polyethylene, PVC (poly vinyl chloride) including polymers, other plastic materials, acrylonitrile-butadiene-styrene). The presence of the web 1120 increases the strength of the fluke 724B thereby increasing the resistive force that a would-be thief would need to overcome if he/she attempted to pull the fluke 724B out of the aperture 725 once locked therein. The web 1120 can be compressed to allow the insertion of the fluke 724B into the aperture 725, as discussed previously. The web 1120 is formed between the stem 723 and the barb 727 when the fluke 724B is molded. It should be understood that it is within the broadest scope of the present invention to include this web 1120 in every fluke 724B discussed previously, including the attachment clip 1124 which uses a fluke on each end (FIGS. 18-19), as well as the fluke element 1104 (FIGS. 23-29).

While the invention has been described in detail and with reference to specific examples thereof, it will be apparent to one skilled in the art that various changes and modifications can be made therein without departing from the spirit and scope thereof.

What is claimed is:

1. A security tag adapted for securing to an article, said security tag comprising: a housing; a releasable locking mechanism associated with said housing of said security tag; an attachment clip comprising a first portion configured to secure to the article independently of said housing; and a second portion that is configured to releasably secure to said housing; and a security element associated with said housing, said security element preventing or hindering a theft of the article.

2. The security tag of claim 1 wherein said first portion passes through said second portion to form a loop, wherein said loop captures at least a portion of the article.

3. The security tag of claim 2 wherein said releasable locking mechanism comprises a first aperture in said housing and a stop adjacent said aperture and wherein said first portion comprises a fluke that compresses as it passes through said aperture and expands once it passes through said aperture, said fluke having a barb that locks against said stop after said fluke has expanded.

4. The security tag of claim 3 wherein said fluke includes a stem and wherein said fluke comprises a web disposed between said stem and said barb.

5. The security tag of claim 3 wherein said releasable locking mechanism further comprises a second aperture in said housing for receiving a detacher therein, said detacher being insertable within said second aperture for compressing said expanded fluke to unlock said barb from said stop.

6. The security tag of claim 5 wherein said attachment clip comprises a first end and a second end corresponding to said first portion and said second portion, said first end comprising said fluke and said second end comprising an aperture through which said fluke is passed to form said loop.

7. The security tag of claim 5 wherein said attachment clip comprises an arcuate tether whose first end comprises said first portion having said fluke and wherein a second end of said arcuate tether comprises second portion having an aperture for passage of said fluke therethrough.

8. The security tag of claim 5 wherein said attachment clip comprises a body including: a first end having a first aperture; a second end corresponding to said second portion wherein said second end comprises a second aperture; a third aperture being positioned approximately at a center of said body; said first portion comprising said fluke being positioned at said body between said first aperture and said third aperture; and wherein said attachment clip is folded around a belt buckle frame to receive a belt prong through said third aperture and wherein said fluke passes through said second aperture to be received in said releasable locking mechanism.

9. The security tag of claim 1 wherein said security element responds to a magnetic or electromagnetic field of a particular frequency or frequencies.

10. The security tag of claim 9 wherein said security element comprises an electronic article surveillance (EAS) element.

11. The security tag of claim 1 wherein said attachment clip is configured to withstand harsh manufacturing conditions.

12. The security tag of claim 1 wherein said security tag is non-ferrous.

13. The security tag of claim 1 wherein said first portion of said attachment clip comprises ends that each include an aperture thereat, wherein either one of said ends is passed through or around the article, said attachment clip being folded to align said apertures and wherein said second portion comprises a connecting element that is passed through said aligned apertures, said connecting element having a first end that is inserted into said releasable locking mechanism and a second end that has an area that is larger than said apertures, said attachment clip being rotatable about said connecting element.

14. The security tag of claim 13 wherein said releasable locking mechanism comprises a first aperture in said housing and a stop adjacent said first aperture and wherein said first end comprises a fluke that compresses as it passes through said first aperture and expands once it passes through said first aperture, said fluke having a barb that locks against said stop after said fluke has expanded.

15. The security tag of claim 14 wherein said fluke includes a stem and wherein said fluke comprises a web disposed between said stem and said barb.

16. The security tag of claim 14 wherein said releasable locking mechanism further comprises a second aperture in said housing for receiving a detacher therein, said detacher being insertable within said second aperture for compressing said expanded fluke to unlock said barb from said stop.

17. The security tag of claim 5 wherein said first aperture comprises a contour and said fluke comprises a first end having a corresponding contour, said contour defining only one orientation that permits said fluke to be inserted within said first aperture.

18. The security tag of claim 17 wherein said housing comprises a third aperture, said first aperture forming a part of said releasable locking mechanism along with a stop adjacent said first aperture and wherein said third aperture comprises a second stop, and wherein each of said ends of said attachment clip comprise a fluke that compresses as it passes through said aperture and expands once it passes through said aperture, each fluke having a barb that locks against said stop after said fluke has expanded.

19. The security tag of claim 18 wherein said third aperture lacks said contour.

20. The security tag of claim 16 wherein said first aperture in said housing comprises a contour and said fluke comprises a first end having a corresponding contour, said contour defining only one orientation that permits said fluke to be inserted within said first aperture in said housing.

* * * * *